US005183630A

United States Patent [19]

Ueda et al.

[11] Patent Number: 5,183,630

[45] Date of Patent: Feb. 2, 1993

[54] PROCESS FOR PRODUCTION OF PERMANENT MAGNET ALLOY HAVING IMPROVED RESISTENCE TO OXIDATION

[75] Inventors: Toshio Ueda; Yuichi Sato; Masayasu Senda; Seiji Isoyama; Seiichi Hisano, all of Tokyo, Japan

[73] Assignee: Dowa Mining Co., Ltd., Tokyo, Japan

[21] Appl. No.: 710,800

[22] Filed: Jun. 4, 1991

Related U.S. Application Data

[62] Division of Ser. No. 565,452, Aug. 9, 1990.

[30] Foreign Application Priority Data

| | | | |
|---|---|---|---|
| Aug. 25, 1989 | [JP] | Japan | 1-217500 |
| Aug. 25, 1989 | [JP] | Japan | 1-217501 |
| Nov. 22, 1989 | [JP] | Japan | 1-301907 |
| Nov. 22, 1989 | [JP] | Japan | 1-301908 |

[51] Int. Cl.[5] ..... B22F 1/02

[52] U.S. Cl. ..... 419/31; 419/44

[58] Field of Search ..... 148/301, 302; 420/83, 420/121; 75/230, 254, 241, 238, 244; 419/10, 11, 12, 14, 25, 26, 29, 30, 31, 35, 38, 39, 44, 45, 46, 48

[56] References Cited

U.S. PATENT DOCUMENTS

| | | | |
|---|---|---|---|
| 4,597,938 | 7/1986 | Matsuura et al. | 419/23 |
| 4,770,723 | 9/1988 | Sagawa et al. | 148/302 |
| 4,792,368 | 12/1988 | Sagawa et al. | 148/302 |
| 4,801,340 | 1/1989 | Inoue et al. | 148/103 |
| 5,022,939 | 6/1991 | Yajima et al. | 148/302 |
| 5,049,208 | 9/1991 | Yajima et al. | 148/302 |

FOREIGN PATENT DOCUMENTS

| | | |
|---|---|---|
| 59-46008 | 3/1984 | Japan . |
| 59-64733 | 4/1984 | Japan . |
| 59-163803 | 9/1984 | Japan . |
| 61-143553 | 7/1986 | Japan . |
| 62-133040 | 6/1987 | Japan . |
| 63-77103 | 4/1988 | Japan . |
| 63-114939 | 5/1988 | Japan . |
| 1-103805 | 4/1989 | Japan . |

*Primary Examiner*—Donald P. Walsh
*Assistant Examiner*—Daniel P. Jenkins
*Attorney, Agent, or Firm*—Frishauf, Holtz, Goodman & Woodward

[57] ABSTRACT

A process for producing a permanent magnet alloy based on a R—Fe—B—C system wherein R is at least one of the rare earth elements including Y, comprising the steps of preparing a molten crude alloy, producing a powder directly therefrom or after casting it into an alloy ingot and then grinding it into the powder, compacting the thus obtained powder and sintering the compacted product, the ingot or powder of the alloy before being sent to the compacting step being subjected to a heat treatment which is carried out at a temperature of 500°-1,100° C. for a period of 0.5 hour or more so as to produce a permanent magnet alloy based on an a R—Fe—B—C system whose individual magnetic crystal grains are covered with an oxidation-resistant protective film which has a C content higher than that of the individual crystal grains.

46 Claims, 7 Drawing Sheets

PROCESS FOR PRODUCTION OF PERMANENT MAGNET ALLOY HAVING IMPROVED RESISTENCE TO OXIDATION

This is a division of application Ser. No. 07/565,452 filed Aug. 9, 1990.

BACKGROUND OF THE INVENTION

The present invention relates to a permanent magnet alloy, as well as a magnet made thereof, that is based on a rare-earth element (R), iron (Fe), boron (B) and carbon (C) or that is based on a rare-earth element (R), iron (Fe), cobalt (Co), boron (B) and carbon (C) and that has improved resistance to oxidation. The invention also relates to a process for producing such an alloy or a magnet. The term "permanent magnet alloy" herein used means a magnetic alloy which is adapted for making a permanent magnet.

Since its first disclosure by Sagawa et al., a magnet based on the R—Fe—B system has been the subject of many reports principally because it has the potential to be used as a next-generation magnet that surpasses Sm—Co based magnets in terms of magnetic force produced. However, though that magnet surpasses Sm—Co based magnets in terms of magnetic force, the heat stability of the magnetic characteristics and oxidation resistance of the new magnet are far inferior to those of said prior art magnets. For instance, the permanent magnet material described in Japanese Patent Public Disclosure No. 59-46008 is not capable of withstanding use in practical applications.

Many of the reports on said new magnets that have been published to data point out their shortcomings in regard of oxidation resistance and propose various methods for improvement, which are roughly divided into two categories, one based on modifying alloy compositions and the other based on covering the surface of magnets with an oxidation-resistant protective film. As an example of the methods of the first approach, Japanese Patent Public Disclosure No. 59-64733 teaches that a magnet can be made corrosion-resistant by replacing part of Fe with Co. Japanese Patent Disclosure No. 63-114939 teaches that improved oxidation resistance can be provided by incorporating in the matrix phase a low melting metal element such as Al, Zn or Sn or a high melting metal element such as Fe, Co or Ni. Further, Japanese Patent Public Disclosure Nos. 62-133040 and 63-77103 show that C (carbon) in a magnet promotes its oxidation and hence its oxidation resistance can be improved by reducing the C content to a level below a certain limit.

However, the effectiveness of these methods which solely depend upon the modification of alloy compositions for improving the resistance to oxidation is limited and it is difficult to produce magnets that reasonably withstand use in practical applications. Under these circumstances, it is necessary to manufacture a practicable magnet by coating its surface (the outermost exposed surface of the magnet) with an oxidation-resistant protective film through many complicated steps as shown in Japanese Patent Public Disclosure No. 63-114939.

It has been proposed that the oxidation-resistant protective film be formed on the surface of a magnet by covering it with an oxidation-resistant material by various methods such as plating, sputtering, evaporation and coating of organic materials. However, in each of these cases, a rugged and homogeneous protective film layer must be formed in a thickness of at least several tens of μms on the outer surface of the magnet. The procedure of forming such a thick layer requires many and complicated steps, which unavoidably results in such problems as spalling, low dimensional accuracy and increased production cost.

As described above, the existing R—Fe—B, R—Fe—Co—B and R—Fe—Co—B—C based magnets are not completely satisfactory in their ability to resist oxidation. As a matter of fact, these magnets have superior magnetic characteristics over Sm—Co based magnets and in addition, they have a great advantage in that they can be supplied consistently from abundant resources. However, these magnets cannot be put to practical use unless they are insulated from the operating atmosphere by means of an oxidation-resistant protective film formed on their surface and the above-described great advantage of these magnets is substantially compromised by the increased production cost and such problems as variations in dimensional accuracy.

A magnet based on R—Fe—B system is generally composed of magnetic crystal grains and a non-magnetic phase including a B-rich phase and a Nd-rich phase. A plausible explanation for the mechanism of oxidation that occurs in the magnet is that oxidation starts in the B-rich phase on either the magnet surface or in a nearby area and proceeds into the Nd-rich phase. Thus, it can be concluded that in order to improve the oxidation resistance of the magnet, it is necessary that not only the B content be reduced to the lowest possible level but also oxidation resistance be imparted to the Nd-rich phase. However, with the state of the art, the B content must inevitably be increased in order to attain magnetic characteristics of high practical levels, and no significant results have been achieved in the efforts to impart oxidation resistance to the Nd-rich phase.

As already mentioned, Japanese Patent Public Disclosure No. 59-64733 proposes that corrosion resistance be imparted by replacing part of Fe with Co but it makes no mention at all of the relevancy of the B content to oxidation resistance. The only disclosure given in this patent in regard of the B content is as follows: the B content is adjusted to lie within the range of 2–28 at. % in order to secure a coercive force (iHc) of at least 1 kOe; in order to insure iHc of 3 kOe, the B content must be at least 4 at. %; and in order to attain high practical levels of iHc, the B content is further increased. However, if boron is to be contained in an increased amount with a view to attaining high magnetic characteristics, it is very difficult in practice to secure satisfactory oxidation resistance even if corrosion resistance is imparted by adding Co. Hence, in order to make a commercial magnet having high B content, it is essential to form a rugged oxidation-resistant protective film on the surface (the outermost exposed surface) of a magnet as taught by the inventors of the invention described in the Japanese Patent Public Disclosure mentioned at the beginning of this paragraph.

Japanese Patent Public Disclosure No. 63-114939 teaches the inclusion of a low melting metal element (e.g. Al, Zn or Sn) or a high melting metal (e.g. Fe, Co or Ni) in the matrix phase in order to improve the oxidation resistance of the active Nd-rich phase. According to an example shown in this patent, a weathering test (60° C.×90% RH) was conducted on a sinter and the period of time for which it could be left to stand until red rust developed noticeably on the surface of the magnet was prolonged to 100 h from 25 h which was the value for a comparative sample. However, the magnet having this level of oxidation resistance is not suitable for use in practical situations unless the surface of the magnet is protected by a rugged oxidation-resistant film. Thus, in this case, too, it is difficult to achieve a substantial improvement in the oxidation resistance of the magnet per se. It should also be noted that this Japanese Patent Public Disclosure makes no mention at all of the B content with regard to oxidation resistance and in the light of the B content which ranges from 3.5 to 6.7 at. % that is specified in the examples, one may safely conclude that the inclusion of B within the range of 2-28 at. % as set forth in Japanese Patent Public Disclosure No. 59-46008 is also contemplated by this publication.

SUMMARY OF THE INVENTION

The principal object, therefore, of the present invention is to solve the aforementioned problems, particularly with respect to oxidation resistance, of prior art R—Fe—B—C or R—Fe—Co—B—C based permanent magnets by imparting higher oxidation resistance to the magnets per se without sacrificing their high magnetic characteristics rather than by forming an oxidation-resistant protective film on the outermost exposed surface of the magnets.

In order to solve the aforementioned problems of the prior art, the present inventors conducted intensive studies on the improvement of the oxidation resistance of the above-mentioned permanent magnets not by taking the conventional "macroscopic" approach which involves coating the surface of the magnet with an oxidation-resistant protective film but by taking a "microscopic" approach that is capable of improving the oxidation resistance of the magnet per se. As a result, the present inventors discovered a novel technique that was not even anticipated from the prior art and that involves coating the individual magnetic crystal grains in the magnet with an oxidation-resistant protective film. By adopting this technique, the present inventors successfully enabled the production of a new permanent magnet alloy having drastically enhanced oxidation resistance. The present inventors also found that by employment of this technique, satisfactory magnetic characteristics that enabled the magnet to withstand practical use could be imparted even when the B content was less than 2 at. %, which was previously considered as an impractical range where satisfactory magnetic characteristics could no longer be achieved by the prior art.

One object of the present invention is to provide a permanent magnet alloy having improved resistance to oxidation which is based on an R—Fe—B—C system (R is at least one of the rare-earth elements including Y), and it is characterized in that the individual magnetic crystal grains of said alloy are covered with an oxidation-resistant protective film 0.05-16 wt % of which is composed of C and which preferably contains at least one, preferably substantially all of the alloying elements of which said magnetic crystal grains are made, with 0.05-16 wt %, preferably 0.1-16 wt % of said protective film being composed of C.

Another object of the present invention is to provide a permanent magnet alloy having improved resistance to oxidation which is based on an R—Fe—Co—B—C system (R is at least one of the rare-earth elements including Y), and it is characterized in that the individual magnetic crystal grains of said alloy are covered with an oxidation-resistant protective film 0.05-16 wt % of which is composed of C and up to 30 wt % (not inclusive of 0 wt %) of which is composed of Co and which preferably contains at least one, preferably substantially all of the alloying elements of which said magnetic crystal grains are made, with 0.05-16 wt %, preferably 0.1-16 wt % of said protective film being composed of C.

A further object of the present invention is to provide a process for producing the above-mentioned an R—Fe—B—C or R—Fe—Co—B—C based permanent magnet alloy.

DETAILED DESCRIPTION OF THE INVENTION

Figure 1:
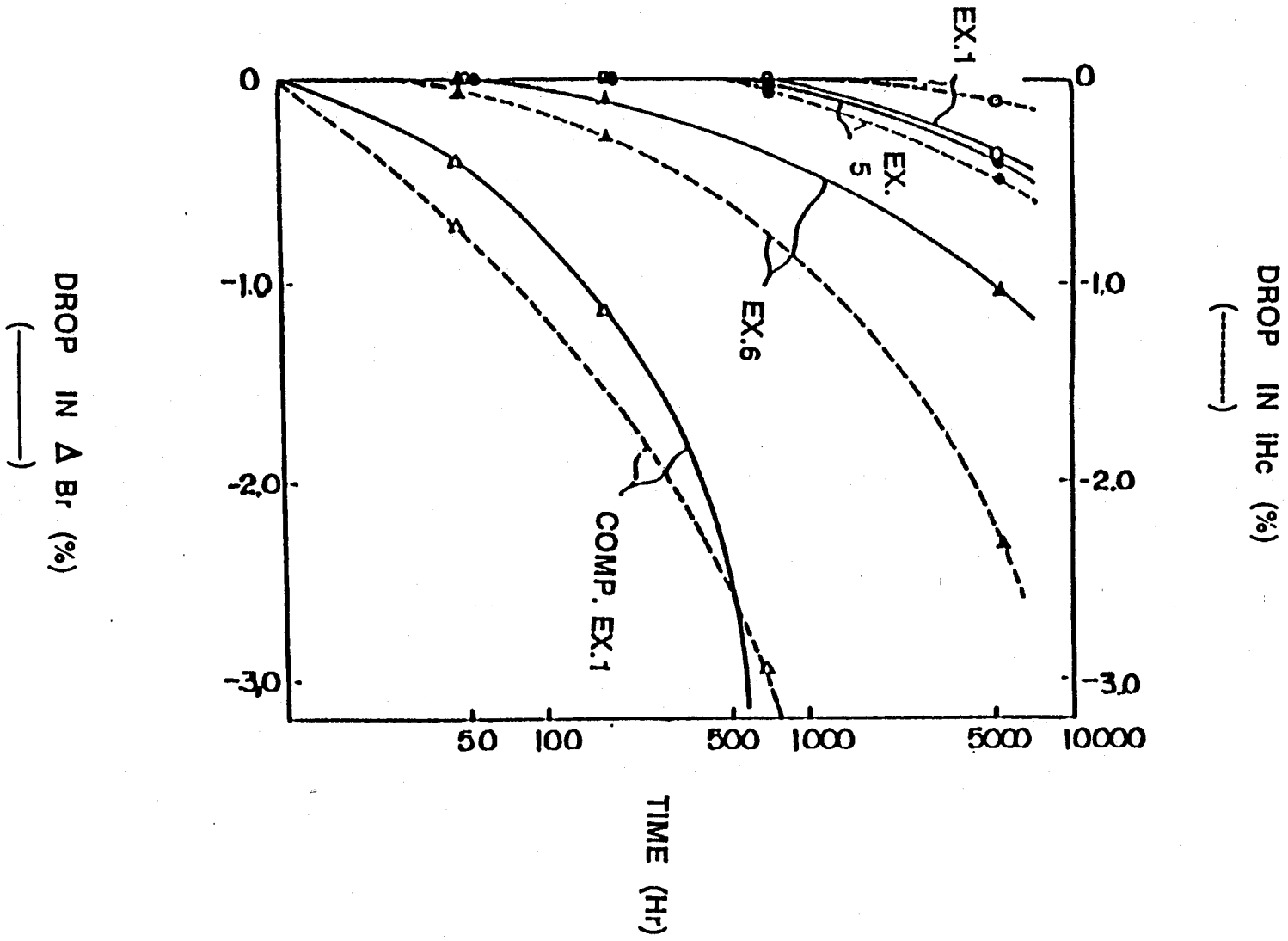
FIG. 1 shows demagnetization curves of Br and iHc for the sintered magnets of the present invention having magnetic crystal grains covered by the C-containing oxidation-resistant protective film (Example 1, 5 and 6) and those for the sintered magnets of the prior art having no such protective layer (Comparative Example 1) when they were left to stand at 60° C. and 90% RH.

The magnetic crystal grains in this magnet have a particle size in the range of 0.3–150 μm, preferably 0.5–50 μm and the oxidation-resistant protective film over these crystal grains has a thickness in the range of 0.001–30 μm, preferably 0.001–15 μm.

In a preferred embodiment, the composition of the R—Fe—B—C based magnet alloy as the sum of the magnetic crystal grains and the oxidation-resistant protective film consists of 10–30% R (which is at least one of the rare-earth elements including Y), less than 2% (not inclusive of zero percent) of B, 0.1–20%, perferably 0.5–20% C., all percentages being on an atomic basis, with the balance being Fe and incidental impurities. In the present invention, satisfactory improvement in oxidation resistance can be achieved even if the B content is 2% or more, but particularly good results are attained at a lower B level (<2%) in that satisfactory magnetic characteristics are exhibited as accompanied by a marked improvement in oxidation resistance.

In a preferred embodiment, the composition of the R—Fe—Co—B—C based magnet alloy as the sum of the magnetic crystal grains and the oxidation-resistant protective film consists of 10–30% R (which is at least one of the rare-earth elements including Y), less than 2% (not inclusive of zero percent) of B, 0.1–20%, perferably 0.5–20% C., up to 40% (not inclusive of zero percent) Co, all percentages being on an atomic basis, with the balance being Fe and incidental impurities. In the present invention, satisfactory improvement in oxidation resistance can be achieved even if the B content is 2% or more, but particularly good results are attained at a lower B level (<2%) in that satisfactory magnetic characteristics are exhibited as accompanied by a marked improvement in oxidation resistance.

A further object of the present invention is to provide a process for producing an R—Fe—B—C or R—Fe—Co—B—C based alloy magnet, and it has been accomplished based on the following findings: it is possible to cover individual magnetic crystal grains of a magnet with an oxidation-resistant protective film if a proper treatment is conducted during a process of producing an alloy comprising the steps of preparing a molten mass of a crude alloy, preparing a powder of said alloy either directly from said molten mass or by casting said molten mass into an alloy ingot followed by crushing the ingot to obtain a powder of said alloy, compacting the resulting powder into a shaped product and sintering the shaped product to provide an R—Fe—B—C or R—Fe—Co—B—C system alloy magnet (where R is at least one of the rare-earth element including Y). The essential points of said treatment are as follows:

(1) heat treating the alloy ingot or the alloy powder at a temperature in the range of 500°–1,100° C. for a period of 0.5 h or more before the ingot or the powder is subjected to the compaction step;

(2) adding part or all of the raw material as a C source or part or all of the raw material as a C source and/or Co source after the step of melting but before the step of compacting; or (3) the combination of the above steps (1) and (2). By the treatment mentioned above, an oxidation-resistant protective film having the C content higher than that of the magnetic crystal grains or an oxidation-resistant protective film having the C content higher than that of the magnetic crystal grains and also containing Co was formed surrounding the magnetic crystal grains and an R—Fe—B—C or R—Fe—Co—B—C based permanent magnet alloy having an excellent oxidation resistance was produced.

In either of the above magnet alloys, 0.05–16 wt %, preferably 0.1–16 wt % of the oxidation-resistant protective film formed on the surface of the individual magnetic crystal grains consists of C. Preferably, the oxidation-resistant protective film contains at least one, preferably substantially all of the alloying elements of which said magnetic crystal grains are made, with 0.05–16 wt %, preferably 0.1–16 wt % of said protective film being composed of C. Alternatively, the oxidation-resistant protective film formed on the surface of the individual magnetic crystal grains contains not only C but also Co, with 0.05–16 wt %, preferably 0.1–16 wt % of the protective film being C and up to 30 wt % (not inclusive of 0 wt %) of the film being Co. More preferably, said protective film contains at least one, preferably substantially all of the alloying elements of which said magnetic crystal grains are made, with 0.05–16 wt %, preferably 0.1–16 wt % of said protective film being composed of C, and up to 30 wt % (not inclusive of 0%) of said protective film being Co. The thickness of the oxidation-resistant protective film is in the range of 0.001–30 μm, preferably 0.001–15 μm and the particle size of the magnetic crystal grain is in the range of 0.3–150 μm, preferably 0.5–50 μm.

According to the process of the present invention, one can obtain a permanent magnet alloy having a composition, as the sum of the crystal grains and the oxidation-resistant protective film, of 10–30% R, less than 2% (not inclusive of zero percent) B, 0.1–20%, preferably 0.5–20% C., all percentages being on an atomic basis, with the balance being Fe and impurities, or a permanent magnet alloy having a composition, as the sum of the crystal grains and the oxidation-resistant protective film, of 10–30% R, less than 2% (not inclusive of zero percent) B, 0.1–20%, preferably 0.5–20% C., up to 40% (not inclusive of zero percent) Co, all percentages being on an atomic basis, with the balance being Fe and impurities. This is a novel permanent magnet alloy which can be distinguished from the prior art permanent magnet alloy in an aspect that each of the individual magnetic crystal grains is covered with an oxidation-resistant protective film and in addition it can exhibit excellent magnetic characteristics even if the B content is less than 2%.

If we guess correctly, the theory is as follows: when the heat treatment of the alloy ingot or powder mentioned above under (1) is effected, the element C or the elements C and Co contained in said alloy ingot or powder in the state of solid solution is concentrated or precipitates at the grain boundary interface, and this C or the combination of C and Co is concentrated during the step of sintering at the grain boundary phase which exists surrounding magnetic crystal grains. As a result, the oxidation-resistant protective film is formed around the magnetic crystal grains. When the treatment mentioned above under (2) is effected, the element C as a raw material or the elements C and/or Co as raw materials are added from an external source to the powder before the steps of compaction and sintering. Hence this C or both C and Co are concentrated, as in the case previously mentioned, during the step of sintering at the grain boundary phase which exists surrounding the magnetic crystal grains and the oxidation-resistant protective film is formed around the magnetic crystal grains.

The permanent magnet of the present invention exhibits improved oxidation resistance by itself even if its outermost surface is not covered with an oxidation-resistant protective film as in the prior art. Thus, even if this magnet is left to stand in a hot and humid atmosphere (60° C.×90% RH) for 5,040 h with its surface exposed to the atmosphere, it will experience a very low level of demagnetization as evidenced by the decreases of 0.3–10% and 0–10% in Br (magnetic remanence or retentivity) and iHc, respectively. Hence, the permanent magnet of the present invention need not be protected with an oxidation-resistant surface film even if it is to be used in such a hot and humid atmosphere. This ability to resist oxidation and hence demagnetization was not achievable by the conventional magnets and in this respect, the magnet of the present invention is an entirely novel permanent magnet.

The magnetic characteristics of the magnet of the present invention are such that Br≧4,000 G, iHc≧4,000 Oe and (BH)max≧4 MG Oe if it is an isotropic sintered magnet, and Br≧7,000 G, iHc≧4,000 Oe, and (BH) max≧10 MG Oe if it is an anisotropic sintered magnet. Thus, it is at least comparable to or even better than the existing R—Fe—B or R—Fe—Co—B based—, particularly Nd—Fe—B or R—Fe—Co—B based permanent magnets in terms of magnetic characteristics.

These characteristics of the magnet of the present invention were attained by surrounding the individual magnetic crystal grains in the magnet with a non-magnetic film having an appropriate C content or having appropriate C and Co contents. To state more specifically, the present inventors found that a great ability to resist oxidation could be imparted to the non-magnetic phase of a magnet by incorporating a selected amount of C (carbon) or selected amounts of both C (carbon) and Co (cobalt) in the grain boundary phase, i.e., the non-magnetic phase of the magnet. That is, a great ability to resist oxidation could be imparted to the non-magnetic film by incorporating therein not more than 16 wt % of said film of C., preferably 0.05–16 wt % of said film of C, more preferably 0.1–16 wt % of said film of C. The present inventors also found that in the co-existence of up to 30 wt % of said film of Co, the above-mentioned advantage of the addition of C could be enhanced.

In addition, the present inventors obtained the following observations: by coating the individual magnetic crystal grains of the magnet with a non-magnetic film having the oxidation-resisting ability described above, satisfactory resistance to oxidation could be achieved even when the B content was comparable to the conventionally used level; and the formation of the C-containing or the C- and Co-containing protective film allowed for reduction in the B content, whereby a marked improvement in oxidation resistance could be achieved whereas the magnetic characteristics were comparable to or better than the heretofore attained level even when the B content was less than 2 at. %.

One of the most characteristic aspects of the magnet of the present invention lies in the way it utilizes C (carbon). Carbon has generally been considered as an incidental impurity element that is unavoidably present in magnets of the type contemplated by the present invention and except in special cases, it has not been dealt with as an alloying element that is to be intentionally added. For instance, Japanese Patent Public Disclosure No. 59-46008 specifies the inclusion of 2–28 at.% B in a magnet and points out that its coercive force (iHc) will decrease below 1 kOe if the B content is less than 2 at.%. This patent merely states that part of B may be replaced with C from an economic viewpoint (i.e. reduction in production cost). Further, Japanese Patent Public Disclosure No. 59-163803 discloses an R—Fe—Co—B—C based magnet containing 2–28 at.% B and up to 4 at.% C. This patent teaches the combined use of B and C in a specific way but notwithstanding its use in combination with C, boron must be contained in an amount of at least 2 at.% and it is specifically mentioned that below 2 at.% B, the magnet has an iHc of less than 1 kOe as in the case described in Japanese Patent Public Disclosure No. 59-46008. In other words, as said patent points out, carbon is considered as an impurity that is detrimental to magnetic characteristics and it is unavoidable that the magnet is contaminated by C which originates from lubricants and other additives used in the compaction of powders. Since the procedure of completely eliminating this impurity increases the production cost, the patent proposes that the C content of up to 4 at.% be permissible if the Br value to be achieved is no more than 4,000 G which is comparable to that of a hard ferrite magnet. Hence, carbon produces negative effects on magnetic characteristics and it is not necessarily an essential element. Further, this patent does not suggest at all the formation of a C-containing, or a C- and Co-containing oxidation-resistant protective film (non-magnetic phase).

Japanese Patent Public Disclosure No. 62-133040 teaches that a higher C content is not desirable for the purpose of improving the oxidation resistance of R—Fe—Co—B—C based magnets and on the basis of this observation, it proposes that the C content be reduced to 0.05 wt % (ca. 0.3% on an atomic basis) or below. Japanese Patent Public Disclosure No. 63-77103 filed by a different applicant also proposes that the C content be reduced to 1,000 ppm or below to attain the same objective. Thus, in the prior art, carbon has not been dealt with as an indispensable element to be added but it has been considered to be a negative element in regard of magnetic and oxidation-resisting properties.

Instead of incorporating C as a mere substituent element for B, the present inventors deliberately incorporated it in the non-magnetic phase (grain boundary phase) surrounding magnetic crystal grains and found unexpectedly that the carbon incorporated in this way made great contribution to an improvement in the oxidation resistance of the magnet. Further, it was found that this method helped improve the magnetic characteristics of the magnet. It was also found that by incorporating Co in combination with C in said phase, the above-mentioned effect could be more enhanced. In other words, the intentional inclusion of C in the non-magnetic phase offered the advantage that even when the B content was within the known range commonly employed in the art, an improvement in oxidation resistance was achieved, with particularly good results being attained when the B content was less than 2 at.%. It was held in the prior art that iHc would become 1 kOe or below when the B content was less than 2 at.% but in accordance with the present invention, iHc values of at least 4 kOe can be achieved even if the B content is less than 2 at.%. This novel action of the present invention is brought about by the formation of a C-containing or a C- and Co-containing oxidation-resistant protective film that surrounds the individual magnetic crystal grains of the magnet, and compared to the conventional magnets in which carbon is considered to be a negative element because of its seemingly deleterious effects on oxidation resistance and magnetic characteristics, the magnet of the present invention is entirely novel in that it contains carbon as an essential element.

The C-containing or the C- and Co-containing oxidation-resistant protective film which surrounds the individual magnetic crystal grains in the magnet of the present invention preferably contains not only C or not only C and Co but also at least one, preferably substantially all of the alloying elements of which said magnetic crystal grains are made. Such a C-containing or C- and Co-containing oxidation-resistant protective film can be formed by incorporating carbon or both carbon and cobalt in the grain boundary layer that exists between magnetic crystal grains in the magnet. A plausible reason for this possibility may be explained as follows: since the protective film mentioned above preferably contains at least one or substantially all of the alloying elements of which the magnetic crystal grains are made, the formation of R—Fe—C or R—Fe—Co—C intermetallic compounds would play an important role; it is generally held that rare-earth elements will easily rust and that their carbides are highly susceptible to hydrolysis; however, in the protective film formed in accordance with the present invention, intermetallic compounds comprising R, Fe and C or R, Fe, Co and C in unspecified proportions would be generated to minimize the occurrence of the defects described above.

As regards cobalt, it has been known as previously described that Co is an element which enhances the Curie point and which can be used to replace part of Fe to provide the alloy with oxidation-resistance. However, the prior art incorporation of cobalt in such manner could not impart satisfactory oxidation resistance to the magnets per se, and therefore it was still necessary to form an oxidation-resistant protective film on the outermost exposed surface of a magnet. In the present invention Co is used for imparting higher oxidation resistance to the magnets per se by incorporating it in combination with C in the oxidation-resistant protective film which is formed surrounding the individual magnetic crystal grains.

As described above, the present inventors found that by covering the individual magnetic crystal grains of the magnet with a C-containing or a C- and Co-containing oxidation-resistant protective film, its oxidation resistance could be markedly improved and that this effect was further enhanced by reducing the B content of the magnet. On the basis of these findings, the inventors succeeded in producing a high-performance permanent magnet that was hardly unattainable by the prior art technology.

It is necessary for the purposes of the present invention that the C-containing or the C- and Co-containing oxidation-resistant protective film described above preferably contains at least one, preferably substantially all of the alloying elements of which the magnetic crystal grains in the magnet are made and that the C content of said protective film be within the range of up to 16 wt % (exclusive of 0 wt %), preferably 0.05–16 wt %, more preferably 0.1–16% of the total weight of said film.

In the case when the oxidation-resistant protective film also contains Co, it is necessary that Co is contained in an amount of up to 30 wt %. The carbon in the protective film is effective not only in imparting oxidation resistance to the magnet but also in minimizing the possible decrease in iHc that may result from the lower B content. Hence, the carbon content of the protective film must be within the range of from 0.05 to 16 wt %, preferably from 0.1 to 16 wt %, more preferably from 0.2 to 12 wt %, of the protective film. If the C content of the protective film is less than 0.1 wt %, particularly less than 0.05 wt %, oxidation resistance will not be satisfactorily imparted or will not be imparted at all to the magnet and its iHc will become lower than 4 kOe. If the C content of the protective film exceeds 16 wt %, the magnet will experience such a great drop in Br that it is no longer useful in practical applications.

In reference to the case when Co is also contained in the protective film, the effect of improving the oxidation resistance will become saturated if the amount of Co exceeds 30 wt %. Rather, such high Co content will result in the drop in Br and iHc. Thus, the Co content of said protective film should be in the range of up to 30 wt %.

In addition to C, or in addition to C and Co, the protective film preferably contains at least one, preferably substantially all of the alloying elements of which the magnetic crystal grains are made although their proportions in the protective film may differ from those in the magnetic crystal grains. The thickness of the protective film is not critical and resistance to oxidation is substantially retained as long as said film provides a uniform coating over the individual magnetic crystal grains. However, if the thickness of that film is less than 0.001 μm, iHc will drop significantly. If the thickness of the protective film exceeds 15 μm, or particularly exceeds 30 μm, Br will no longer be able to provide the value intended by the present invention. Hence, the thickness of the protective film is to be in the range of from 0.001 μm to 30 μm, preferably within the range of from 0.001 to 15 μm, more preferably within the range of from 0.005 to 12 μm. The thickness of the protective film described above should be taken as a value that includes the triple point at the grain boundary. The thickness of the protective film may be measured with a transmission electron microscope (TEM) as in the examples to be described hereinafter.

The individual magnetic crystal grains which are surrounded by the oxidation-resistant protective film may have a composition similar to that of well-known R—Fe—B—(C) or R—Fe—Co—B—(C) based permanent magnets, except that the magnet of the present invention is capable of exhibiting satisfactory magnetic characteristics even if the B content is lower than in the prior art magnets. The composition of the C-containing no cobalt alloy magnet of the present invention as the sum of the magnetic crystal grains and the oxidation-resistant protective film preferably consists of 10–30% R, less than 2% (not inclusive of zero percent) B, 0.1–20%, preferably 0.5–20% C., all percentages being on an atomic basis, with the balance being Fe and incidental impurities. The composition of the both C- and Co-containing alloy magnet of the present invention as the sum of the magnetic crystal grains and the oxidation-resistant protective film preferably consists of 10-30% R, less than 2% (not inclusive of zero percent) B, up to 40% (not inclusive of zero percent) Co, 0.1-20% preferably 0.5-20% C, all percentages being on an atomic basis, with the balance being Fe and incidental impurities.

The total C content in the magnet of the present invention is in the range of 0.1-20 at.%, preferably in the range of 0.5-20 at.%. If the total content of carbon in the magnet exceeds 20 at.%, Br will drop significantly and the values desirable for the present invention (Br≧4 kG with an isotropic sintered magnet, and Br≧7 kG with an anisotropic sintered magnet) can no longer be achieved. If the total content of carbon in the magnet is less than 0.5 at.%, particularly less than 0.1 at.%, it is no longer possible to impart desired oxidation resistance. Hence, the preferred range of the total carbon content in the magnet of the present invention is from 0.1 to 20 at.%, preferably from 0.5 to 20 at.%. As already mentioned, the carbon in the oxidation-resistant protective film is effective not only in imparting oxidation resistance to the magnet but also in minimizing the possible decrease in iHc that may result from the lower B content. Hence, carbon content of this protective film must be up to 16 wt % (not inclusive of 0 wt %), preferably in the range of 0.05-16 wt %, more preferably within the range of 0.1 to 16 wt %, more preferably from 0.1 to 12 wt %, and the most preferably in the range of 0.2-12 wt % of the protective film. Carbon sources that may be used in the present invention include carbon black, high-purity carbon, and alloys such as Nd—C and Fe—C.

The symbol R used in the present invention represents a rare-earth element which is at least one member selected from the group consisting of Y, La, Ce, Nd, Pr, Tb, Dy, Ho, Er, Sm, Gd, Eu, Pm, Tm, Yb and Lu. If desired, misch metal, didymium and other mixtures of rare-earth elements may also be used. The content of R in the magnet of the present invention is preferably within the range of from 10 to 30 at.% since the values of Br exhibited within this range are highly satisfactory for practical purposes.

Boron to be used in the present invention may be pure boron or ferroboron. Even if the B content exceeds 2 at.% which is one of the critical value conventionally used in the prior art, the magnet of the present invention has markedly improved oxidation resistance as compared with the prior art versions and the already stated objects of the present invention can be attained. Preferably, the B content is less than 2 at.% and much better results can be attained if the B content is 1.8 at.% or less. If boron is absent from the magnet, its oxidation resistance is improved but on the other hand, iHc will drop so greatly that the objectives of the present invention can no longer be attained. If ferroboron is to be used, it may contain impurities such as Al or Si.

In reference to the case when Co is incorporated in the protective film, Co sources that may be used in the present invention include electrolytic cobalt, alloys such as Nd—Co, Fe—Co, Co—C, etc. The total amount of Co to be incorporated in the magnet (as the sum of the amounts contained both in the oxidation-resistant protective film and in the magnetic crystal grains) is up to 40 at.%. This is because the incorporation of Co exceeding 40 at.% will also result in the significant drop of Br and iHc and therefore the permanent magnet desirable for the present invention can no longer be attained.

As described above, the permanent magnet alloy of the present invention has the individual magnetic crystal grains covered with the C-containing or the both C- and Co-containing oxidation-resistant protective film whose thickness is in the range of from 0.001 to 30 μm, preferably within the range of from 0.001 to 15 μm, more preferably from 0.005 to 12 μm. The magnetic crystal grains in this alloy preferably have a grain size within the range of 0.3-150 μm, preferably within the range of 0.5-50 μm, more preferably in the range of 1-30 μm. If the size of the magnetic crystal grains is less than 0.5 μm, particularly less than 0.3 μm, the iHc of the magnet will become less than 4 kOe. If the size of the magnetic crystal grains exceeds 50 μm, particularly when it exceeds 150 μm, the iHc of the magnet will drop significantly to such an extent that the characteristic features of the magnet of the present invention will be substantially lost. The size of the magnetic crystal grains in the magnet of the present invention can be correctly measured with a scanning electron microscope (SEM) and its composition can be correctly analyzed with an electron probe microanalyzer (EPMA), as in the examples to be described hereinafter.

If the permanent magnet of the present invention is to be made as a sintered alloy, it can be produced by a conventional process which comprises a sequence of melting, casting, pulverizing, compacting and sintering steps, or a sequence of melting, casting, pulverizing, compacting, sintering and heat treating steps. Preferably, more advantageous results can be attained by modifying this production process in such a way that the casting operation is followed by the step of heat treating the cast alloy, or that part or all of the C source or alternatively part or all of the C and Co sources is additionally added during or after the pulverizing step. If desired, these two modifications may be adopted in combination. If, on the other hand, the permanent magnet of the present invention is to be made as a cast alloy, a hot plastic working process may be employed to fabricate a product that exhibits the desirable effects of the present invention which are already described above.

The alloy powder made of the permanent magnet alloy of the present invention can provide a bonded magnet which exhibits improved oxidation resistance as compared with the prior art product. Because of its having highly improved oxidation resistance, hardly rusting characteristic properties and excellent magnetic properties as compared with the prior art products, the permanent magnet alloy of the present invention can be advantageously used in various products in which a magnet is practically used. Examples of magnet applied products include, for example, the following:

Electric motors such as a DC brushless motor and a servo-motor; actuators such as a driving actuator and a F/T actuator for optical pickup; acoustic instruments such as a speaker, a headphone and an earphone; sensors such as a rotating sensor and a magnetic sensor; a substitute for an electro-magnet such as MRI; relays such as a reed relay and a polarized relay; magnetic couplings such as a brake and a clutch; vibration oscillators such as a buzzer and a chime; adsorptive instruments such as a magnetic separator and a magnetic chuck; switching instruments such as an electromagnetic switch, a microswitch and a rodless air cylinder; microwave instruments such as a photoisolator, a klystron and a magnetron; magneto generators; health-promoting instruments; and toys, etc.

The above-listed products are no more than part of the examples of the products to which a magnet alloy of the present invention can be applied. The application of the magnet alloy should not be limited thereto. The permanent magnet alloy of the present invention can be characterized by its improved resistance to rusting. It has eliminated the necessity of forming an oxidation-resistant protective film on the outermost exposed surface of the magnet which was necessary to the prior art products. Without sacrificing its high magnetic properties, higher oxidation resistance is imparted to the magnet per se. Hence, generally the protective film on the outermost exposed surface thereof need not be formed. There may be some special cases when such conventional protective film should be formed on the exposed surface of the magnet of the present invention such as in the case when they are to be used in some special circumstances. Even in such a case, the magnet of the present invention has its merits in that there will be no rust from inside the magnet and accordingly good adhension can be obtained when the protective film is to be formed on the exposed surface of the magnet. This will eliminate the problems such as the peeling of the film due to poor adhension and the problem of bad dimensional precision due to the variation of film thickness. Thus, we can provide the permanent magnets most suitable for uses in which oxidation resistance is required.

In another aspect, the present invention is to provide a process for producing an R—Fe—B—C based, or an R—Fe—Co—B—C based permanent magnet alloy having such a characteristic structure that individual magnetic crystal grains of said alloy are covered with a non-magnetic film which has the C content higher than that of the magnetic crystal grains and optionally contains Co. Thus, the behavior of C, or the behavior of both C and Co is very important. Hence, first reference will be given to C in question.

Behavior of C

So far, C in the magnet of this system has been considered as follows. For instance, Japanese Patent Public Disclosure No. 59-46008 specifies the inclusion of 2-28 at.% B in a magnet and points out that its coercive force (iHc) will decrease below 1 kOe if the B content is less than 2 at.%. This patent merely states that if a large amount of B is to be used, part of B may be replaced with C for the reduction in production cost. Further, Japanese Patent Public Disclosure No. 59-163803 discloses an R—Fe—Co—B—C based magnet containing 2-28 at.% B and up to 4 at.% C. This patent teaches the combined use of B and C in a specific way but notwithstanding its use in combination with C, boron must be contained in an amount of at least 2 at.% and it is specifically mentioned that below 2 at.% B, the magnet has an iHc of less than 1 kOe as in the case described in Japanese Patent Public Disclosure No. 59-46008. In other words, as said patent points out, carbon is considered as an impurity that is detrimental to magnetic characteristics and it is unavoidable that the magnet is contaminated by C which originates from lubricants and other additives used in the compaction of powders. Since the procedure of completely eliminating this impurity increases the production cost, the patent proposes that the C content of up to 4 at.% be permissible if the Br value to be achieved is no more than 4,000 G which is comparable to that of a hard ferrite magnet. Hence, carbon produces negative effects on magnetic characteristics and it is not necessarily an essential element. Japanese Patent Public Disclosure No. 62-13304 proposes that for the purpose of improving the oxidation resistance of R—Fe—Co—B—C based magnets the C content be reduced to 0.05 wt % (ca. 0.3% on an atomic basis or below). Japanese Patent Public Disclosure No. 63-77103 filed by a different applicant also proposes that the C content be reduced to 1,000 ppm or below to attain the same objective. Thus, in the prior art, carbon has been considered to be a negative element also in regard of oxidation-resisting properties.

The present inventors deliberately incorporated C, which had been considered as a negative element for the magnetic characteristics and the oxidation-resistant properties, in the grain boundary phase and found that this enabled the formation of an oxidation-resistant protective film on the surface of individual magnetic crystal grains and that this helped improve the magnetic characteristics of the magnet. In other words, the intentional inclusion of C in the grain boundary phase offered the advantage that even when the B content was within the known range commonly employed in the art, an improvement in oxidation resistance was achieved, with particularly good results being attained when the B content was less than 2 at.%. It was held in the prior art that iHc would become 1 kOe or below when the B content was less than 2 at.% but in accordance with the present invention, iHc values of at least 4 kOe can be achieved even if the B content is less than 2 at.%. This novel effect has been attained by the formation of the C-containing oxidation-resistant protective film.

Next, reference will be given to Co which is optionally incorporated in said protective film in combination with C.

Behavior of Co

In the process of the present invention, Co is optionally incorporated in combination with C in the grain boundary phase. It has been found that this contributes to increasing the oxidation-resistant properties of the oxidation-resistant protective film mentioned above. It is known that Co is an element to enhance the Curie point and can be used as a substitute element for Fe to provide the R—Fe—Co—B—C based magnet with oxidation resistance. However, it is also known that in the case of prior art alloys, completely satisfactory oxidation resistance cannot be provided by such a method, and it is necessary to form an oxidation-resistant protective film on the surface of a magnet product (the outermost exposed surface of the magnet). The present invention provides a process for drastically enhancing the oxidation resistance of the above-mentioned type magnet by positively incorporating C, or both C and Co in the oxidation-resistant protective film which is formed on the individual magnetic crystal grains as a homogeneous and strong protective film, and as a means to form such an oxidation-resistant protective film, advantageously, the process of the invention contains one of the special treatments explained hereinbefore under (1), (2) and (3).

The heat treatment explained above under (1), i.e., the heat treatment of the alloy ingot or powder before the compaction step at a temperature in the range of 500°-1,100° C. for 0.5 h or more is effective to accelerate the segregation of C or the segregation of C and/or Co into the grain boundary. If the alloy ingot or powder before the steps of compacting and sintering is heated to a temperature in the range of 500°-1,100° C., preferably in the range of 700°-1,050° C., the migration of C or the migration of C and/or Co to the grain boundary interface is caused to result in the segregation of C or the segregation of C and/or Co. Japanese Patent Public Disclosure No. 61-143553 proposes the introduction of a heat-treatment step into the process of producing an alloy for the purpose of dissolving the problem of segregation in the cast alloy composition of an R—Fe—B based alloy. In contrast, the present invention does not aim at avoiding segregation but conducts heat treatment so as to positively cause the segregation of C or the segregation of C and/or Co. Thus, the object of the heat treatment and the manner in which it is effected in the process of the present invention are just the opposite of those used in the prior art process. In addition, the present invention has another merit in that the magnetic characteristics is also improved as a result of such heat treatment as mentioned under (1).

In order to segregate C, or C and/or Co at the grain boundary interface by said heat treatment, the crude alloy should contain C, or C and/or Co. These elements can be the ones contained as contaminants inevitably introduced into the alloy during the melting step. It is more practical, however, that C source material, or C and/or Co source materials are positively added to the alloy during the melting step.

On the other hand, when the method previously mentioned under (2) is employed, i.e., when only the C source material, or the C source material and/or Co source material are added after melting step but before compacting step, the C source material only, or C source material and/or Co source material is secondly added to the crude alloy. Practically, it is preferred to effect this addition by incorporating a fine powder of raw material such as carbon black optionally containing cobalt in the crude alloy powder before the compaction thereof. By compacting and sintering the mixed powder of said crude alloy powder and the powder of said raw materials, the incorporation of C or the incorporation of C and/or Co in the non-magnetic phase of a product magnet can be done more effectively.

Whichever method may be used, the Br value of the final product magnet will be reduced significantly, if the C content of the oxidation-resistant protective film surrounding the individual magnetic crystal grains in the magnet exceeds 16 wt %. Hence, it is preferred to hold said upper limit value of 16 wt %. When Co is also added, if the Co content of the oxidation-resistant protective film exceeds 30 wt %, the effect of improving oxidation resistance will become saturated and, contrary to our expectation, the drop in iHc and Br will become significant. Thus, the Co content is preferably controlled in the range of 30 wt % or less. It is of course possible to form the oxidation-resistant protective film having the intended C content, or the intended C and/or Co content by combining the two methods previously mentioned under (1) and (2). By employing this combined method, it is possible to form a more homogeneous and stronger oxidation-resistant protective film on the surface of the magnetic crystal grains.

Now, the components and the composition of the permanent magnet alloy of the present invention will be explained as follows.

Components and Compositions of Alloys

The composition of the magnet alloy of the present invention (as the sum of the magnetic crystal grains and the oxidation-resistant protective film) preferably consists of 10-30% R, up to 2% (not inclusive of 0 at. %; but, even if less than 2%, satisfactory magnetic characteristics can be realized) B, 0.1-20%, preferably 0.5-20% C, and up to 40% Co when Co is contained, all percentages being on an atomic basis, with the balance being Fe and incidental impurities.

The symbol R used in the present invention as one of the indispensable elements of the alloy of the invention represents a rare-earth element which is one or two or more members selected from the group consisting of Y, La, Ce, Nd, Pr, Tb, Dy, Ho Er, Sm, Gd, Eu, Pm, Tm, Yb and Lu. If desired, misch metal, didymium and other mixtures of rare-earth elements may also be used. The content of R in the magnet of the present invention is preferably within the range of from 10 to 30 at.% since the values of Br exhibited within this range are highly satisfactory for practical purposes.

B may be present in an amount exceeding 2 at.%, which has been the known upper limit of this element, and extending up to 28 at.%. Even within this range of the boron content, the oxidation resistance of the alloy can still be remarkably improved in comparison with the prior art alloy and the objectives of the present invention already mentioned could be attained. Preferably, however, the B content is less than 2 at.% and much better results can be attained if the B con-tent is 1.8 at.% or less. If B is absent from the magnet, its oxidation resistance is improved but on the other hand, iHc will drop significantly. As a B source material pure boron or ferroboron can be used. If ferroboron is to be used, it may contain impurities such as Al or Si.

The total C content of the magnet is in the range of 0.1-20 at.%, preferably in the range of 0.5-20 at.%. The presence of C in the oxidation-resistant protective film is not only effective for providing the protective film with the oxidation resistance but also for restraining the drop of iHc due to the decrease of B. Hence the content of carbon in the protective film is in the range of 0.05-16 wt %, preferably in the range of 0.1-16 wt %, more preferably 0.2-12 wt % in the composition of the oxidation-resistant protective film of the non-magnetic phase. If the C content of the protective film is less than 0.1 wt %, particularly less than 0.05 wt %, oxidation resistance will not be imparted to the magnet, and if then the B content of the same film is low, iHc will become lower than 4 kOe. If the C content of the protective film exceeds 16 wt %, the magnet will experience such a great drop in Br that it is no longer useful in practical applications. As regards the composition of the oxidation-resistant protective film, it preferably contains at least one, preferably substantially all of the alloying elements of which the magnetic crystal grains are made. The total C content of the magnet is preferably set within the range of 0.1-20 at.%, more preferably in the range of 0.5-20 at.% from a practical viewpoint, because if it exceeds 20 at.%, the drop in Br will be significant, and if it is less than 0.5 at.%, particularly less than 0.1 at.%, the oxidation resistance will no longer be imparted to the magnet. As a C source material, carbon black, high purity carbon or alloys such as Nd-C, Fe-C, etc., may be used.

When Co is also incorporated in combination with C, the total Co content of the magnet is preferably set within the range of 40 at.%, or less (exclusive of 0%), because if it exceeds 40 at.%, the drop in iHc and Br will again become significant. If the amount of Co in the composition of the above-mentioned oxidation-resistant protective film exceeds 30 wt %, the degree of improvement in oxidation resistance will not be added significantly and, in addition to this, the drop in iHc and Br will become significant. Thus, the upper limit of the total Co content to be incorporated in the magnet, namely, the upper limit of the total of the Co amount to be contained in the protective film and the Co amount to be present in the magnetic crystal grains should be set 40 at.%, and the upper limit of the Co content of the oxidation-resistant protective film should be set 30 wt %. Usable Co source materials include electrolytic cobalt and alloys such as Nd-Co, Fe-Co, Co-C or the like.

According to the present invention a permanent magnet alloy having the above-mentioned composition is produced by the process including the following steps.

Steps in the Production Process (a) Production of Crude Alloy

Starting materials are weighed and mixed to obtain the mixture having the composition within the above-mentioned desired range. (If the method (2) is to be employed, decreased amount of C or the decreased amount of both C and Co should be used in the raw material mixture considering the amount of C or the amounts of C and Co to be added in the later stage.) Then the mixture is melted under vacuum or in the atmosphere of inert gas by using a high-frequency induction furnace or an arc furnace. The resulting melt is cast into a water-cooled copper mold to form an alloy ingot, or alternatively a powder of the crude alloy is produced from the melt by means of the atomization method or the rotating disc method.

(b) Heat Treatment of the Crude Alloy (Aforementioned Method (1))

The alloy ingot or the alloy powder obtained in the previous step is subjected to heat treatment to thereby cause the segregation of C, or the segregation of C and Co as explained. This heat treatment comprises holding the product at an elevated temperature in the range of 500°-1,100° C., preferably in the range of 700°-1,050° C. in an inert gas atmosphere for a period of 0.5 h or more. In doing this, if the temperature is less than 500° C., satisfactory segregation of C, or of C and Co in the grain boundary phase will not be attained and the improvement of magnetic characteristics will also be unsatisfactory. On the other hand, if the temperature reaches 1,100° C., the advantage mentioned above will saturate. As regards holding time, less than 0.5 h will not bring about any significant advantage. If holding time of 0.5 h or more is given, apparent advantage will be obtained. Since extremely long time holding is economically disadvantageous, holding time of not greater than 24 h is preferred. As regards cooling rate after the heat treatment, no specific limitation will be required. After this heat treatment, grinding to the particle size of 32 mesh or less, preferably 100 mesh or less is effected by means of a jaw crusher, a roll crusher, a stamp mill or the like in an inert gas atmosphere.

(c) Secondary Addition of C Only, or C plus Co Source Material (Aforementioned Method (2))

According to this method, C and/or Co are not added at all, or only part of C and/or Co are added in the melting step and all the necessary or the supplementary amount of C and/or Co are secondly added to incorporate the intended amount of this or these elements in the alloy. This secondary addition may be effected after the step of producing a crude alloy and before the step of compacting the powder. It is also possible to add this or these elements before the heat treatment for causing the segregation of C or the segregation of C and Co mentioned before so that the raw material containing the secondly added C, or C and Co may be subjected to heat treatment. By taking this method, the grain boundary phase having highly segregated C, or highly segregated C and Co phase can be formed. The amount of C, or the amount of C and Co to be added secondly is the difference between the desired amount and the amount already added in the melting stage. In spite of whether the crude alloy is an alloy ingot or a powder, the mixture thereof with a C source material or C and Co source materials secondly added is preferably ground into fine powder by using a ball mill or a vibration mill. Alternatively, a finely powdered C source material or finely powdered C and Co source materials may be added to the finely ground ingot or powder of the crude alloy before it is subjected to the compaction. Whichever method may be chosen, the C source material or C and Co source materials should be fine powder in the range of up to 1 mm, preferably not greater than 200 μm in the particle size.

(d) Compaction Stage

The finely powdered material obtained in the above-mentioned stage is then formed into any desired shape by compaction. Generally, there exists a pulverizing stage for obtaining a fine powder before said compaction-shaping stage. This pulverizing is preferably effected either by a dry process which is carried out in an inert gas atmosphere or by a wet process which is carried out in an organic solvent such as toluene, etc. The average particle size of the powder is controlled within the range of 1-50 μm, preferably 1-20 μm. If the raw material contains C which has been secondly added, this C will function as an agent to promote the pulverization. If the average particle size of the powder obtained by pulverization is less than 1 μm, particularly less than 0.3 μm, the powder is activated too much and is easy to be influenced by the oxidation. As a result, its magnetic characteristics is easy to drop. On the other hand, if the average particle size of the powder produced by pulverization exceeds 50 μm, particularly when it exceeds 150 μm, the magnet produced with this powder will fail to obtain a sufficiently high coercive force. If fine powder having an average particle size of 1-50 μm has been produced from a melt of a crude alloy by means of atomization, the powder can be directly subjected to the step of compaction after the heat treatment previously mentioned under (1) or after the secondary addition of C or C and Co previously mentioned under (2) without being subjected to the step of pulverization stage.

The fine powder thus obtained is then shaped by compaction under the molding pressure preferably in the range of 0.5-5 t/cm$^2$. If high magnetic quality is desired, compaction may be effected under applied magnetic field (in the range of 5-20 kOe). This compaction may be carried out in an organic solvent such as toluene, or alternatively by a dry process using stearic acid, etc., as a lubricant. If the raw material contains the secondly added C, this C also functions as a lubricant during the compaction stage.

(e) Sintering Stage

The compaction product is subsequently subjected to sintering treatment which is carried out in vacuum or in an inert gas or reducing atmosphere. Sintering is carried out at a temperature in the range of 950°-1,150° C., preferably holding the sample at this temperature range for a period of 0.5-4 h. If the sintering temperature is less than 950° C., satisfactorily good sintering will not be attained. If the sintering temperature exceeds 1,150° C., the formation of coarse magnetic crystal grains proceed to result in the significant drop in Br and iHc. Less than 0.5 h of holding time will fail to provide a homogeneous sinter. More than 4 h of holding time will not add the advantage.

In the cooling stage after the sintering treatment, quenching or the combination of slow cooling and quenching is preferably employed. Quenching may be carried out in a gaseous atmosphere or in an oil. Slow cooling may be effected in a furnace. The combination of slow cooling and quenching is the most preferred, and when this combination is used, slow cooling, which follows the sintering stage, is conducted at a cooling rate in the range of 0.5°-20° C./min. until the temperature reaches 600°-1,050° C. at which quenching starts immediately. By treating in this manner, the oxidation-resistant protective film surrounding the magnetic crystal grains is made homogeneous and strong. If slow cooling is effected at a cooling rate out of the specified range of 0.5°-20° C./min., the film will not become sufficiently homogeneous. If quenching is started at a temperature out of the range of 600°-1,050° C., homogenization of said protective film will not be fully attained.

(f) Final Heat Treatment Stage

By subjecting the sintered sample to post heat treatment at a temperature in the range of 400°-1,100° C., preferably 500°-1,050° C. for 0.5-24 h, further improvement of its magnetic property is attained. If this final heat treatment is carried out at a temperature lower than 400° C., the degree of improvement in the magnetic property is small. If it is carried out at a temperature higher than 1,100° C., sintering is accompanied and the resulting magnetic crystal grains will become coarse and the values of Br and iHc will drop. If the sample is held at the above-mentioned temperature range for less than 0.5 h, the degree of improvement in the magnetic property is small. If said holding period exceeds 24 h, the addition of improvement will be small.

The permanent magnet alloy of the present invention prepared by the process mentioned above comprises magnetic crystal grains having a grain size within the range of 0.3-150 μm, preferably in the range of 0.5-50 μm, more preferably in the range of 1-30 μm and the grains are covered with the oxidation-resistant protective film whose thickness is in the range of 0.001-30 μm, preferably in the range of 0.001-15 μm, more preferably in the range of 0.005-15 μm. If the particle size of magnetic crystal grains becomes less than 0.5 μm, particulaly when it becomes less than 0.3 μm, iHc will drop to less than 4 kOe. If said particle size exceeds 50 μm, particularly when it exceeds 150 μm, the iHc of the magnet will drop significantly to such an extent that the characteristic features of the magnet of the present invention will substantially lost. As regards the thickness of the oxidation-resistant protective film, if the protective film uniformly covers the individual magnetic crystal grains, the oxidation resistance will be held at a satisfactory value without depending on the thickness of the protective film. If the protective film becomes less than 0.001 μm thick, iHc of the magnet will drop significantly. If it exceeds 15 μm, particularly when it exceeds 30 μm, the Br of the magnet will drop significantly to such an extent that the characteristic features of the magnet of the present invention will be substantially lost. The thickness of this oxidation-resistant protective film includes the triple point of the grain boundary.

The composition of the magnet alloy of the present invention can be analyzed with an electron probe microanalyzer (EPMA), the size of the magnetic crystal grains can be measured with a scanning electron microscope (SEM), and the thickness of the oxidation-resistant protective film can be measured with a TEM (as in the examples to be described hereinafter).

The following examples are provided for the purpose of further illustrating the characteristics of the magnet of the present invention.

EXAMPLE 1

Starting materials, which consisted of 99.9% pure electrolytic iron, a ferroboron alloy with a boron content of 19.32%, 99.5% pure carbon black, and 98.5% pure neodymium metal containing other rare-earth elements as impurities, were weighed and mixed in such proportions that a composition designated by 18Nd/71Fe/1B/3C (at.%) would be obtained. The mixture was melted under vacuum in a high-frequency induction furnace and thereafter cast into a water-cooled copper mold to form an alloy ingot. The thus obtained alloy ingot was crushed into particles of 10-15 mm in size with a jaw crusher and subsequently held at 700° C. for 5 h, followed by cooling at a rate of 50° C./min. The crushed ingot was then coarsely ground to a size of −100 mesh with a stamp mill in an argon gas. Thereafter, 99.5% pure carbon black was added to the coarsely ground ingot in such an amount that a composition designated by 18Nd/71Fe/1B/10C (at.%) would be obtained. Then, the mixture was finely ground to an average particle size of 5 μm by means of a vibrating mill. The thus obtained alloy powder was compacted at a pressure of 1 ton/cm$^2$ in a magnetic field of 10 kOe, held in an argon gas at 1,100° C. for 1 h and subsequently quenched to obtain a sinter.

COMPARATIVE EXAMPLE 1

A sample was prepared by repeating the procedure of Example 1 except that no carbon black was used. Starting materials were weighed and mixed to provide a composition designated by 18Nd/76Fe/6B (at.%). The mixture was subsequently treated as in Example 1, i.e., it was melted (in the absence of carbon black), coarsely ground, pulverized, compacted in a magnetic field, sintered and quenched to obtain a sinter.

In order to evaluate the oxidation resistance of the sinters, they were subjected to a weathering test in which they were left to stand in a hot and humid atmosphere (60° C.×90% RH) for 7 months (5,040 h). Demagnetization (drop in Br and iHc) data and curves for the respective sinters are shown in Table 1 and FIG. 1, respectively.

As is clear from FIG. 1, the sinter prepared in Example 1 by coating magnetic crystal grains with a C-containing protective film experienced very small degrees of demagnetization (−0.36% in Br as indicated by a solid line, and −0.1% in iHc as indicated by a dashed line) after 7 months, showing that said sinter had very high resistance to oxidation. On the other hand, the sinter prepared in Comparative Example 1 which was not protected by a C-containing film experienced significant demagnetization (−9.8% in Br and −3.0% in iHc) only after 1 month (720 h) and upon further standing, it rusted so heavily that Br and iHc measurements were impossible.

Figure 2:
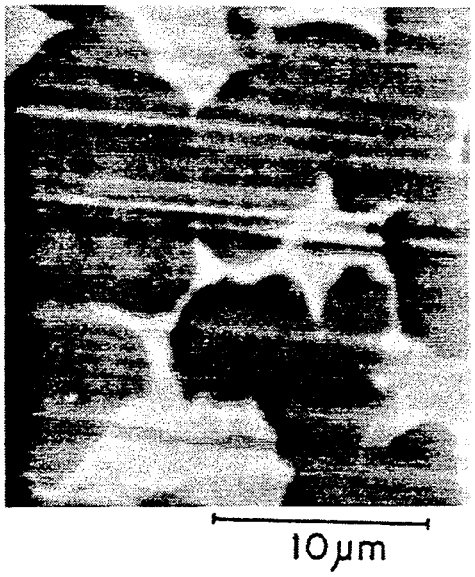
FIG. 2 is an electron micrograph showing the metallic structure of the magnet of the present invention prepared in Example 1.
Figure 3:
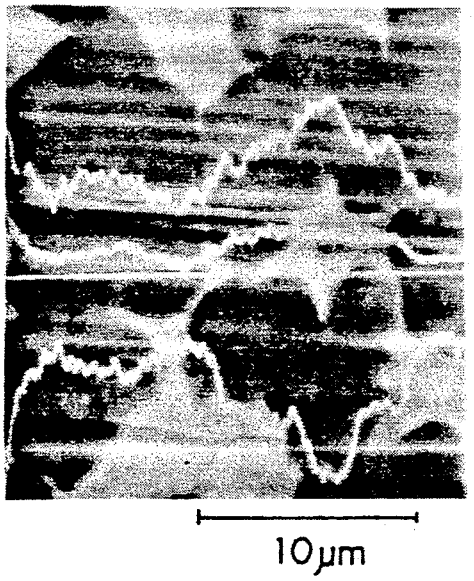
FIG. 3 is a photo showing the result of spectral line analyses for Nd, Fe and C elements in the metallic structure shown in FIG. 2.
Figure 4:
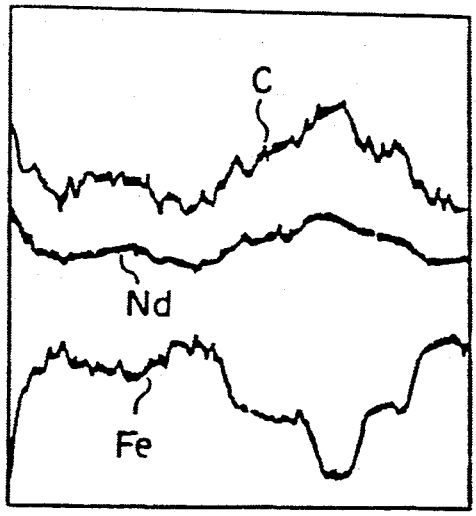
FIG. 4 is a diagram showing the spectral lines of the respective elements as reproduced from FIG. 3.

FIG. 2 is a SEM micrograph showing the microstructure of the sinter of Example 1. The same sinter was subjected to spectral line analyses for C and Nd elements with EPMA and the result is shown in photo in FIG. 3. FIG. 4 shows spectral lines for the respective elements as reproduced from the photo of FIG. 3. These pictures clearly show that the magnetic crystal grains are covered with a C-containing oxidation-resistant protective film and that the greater part of C is present in the Nd-rich portion of this protective film. The C content of the protective film was 6.1 wt %. The size of magnetic crystal grains was measured for 100 grains selected from the SEM micrograph showing the microstructure of the sinter and it was found to be within the range of 0.7-25 μm. The thickness of the protective film as measured with TEM was 0.01-5.6 μm. The values of grain size and film thickness are also shown in Table 1. Magnetization measurements were conducted with a vibrating-sample magnetometer (VSM) and the values of Br, iHc and (BH)max thus measured are shown in Table 1.

As the above results show, the permanent magnet alloy of the present invention is much more resistant to oxidation than the known sample of Comparative Example 1, and the magnetic characteristics of this alloy are comparable to or better than those of the known sample.

EXAMPLES 2-6

Sinters were prepared by repeating the procedure of Example 1 except that the starting materials to be melted were weighed and mixed to provide the boron (B) contents shown in Table 1.

COMPARATIVE EXAMPLE 2

A sinter was prepared by the same procedure except that no boron was incorporated (B=0 at.%).

The oxidation resistance of each sinter, the C content of the protective film, the size of magnetic crystal grains, the thickness of the protective film and the magnetic characteristics of each sinter were evaluated as in Example 1 and the results are shown in Table 1. Demagnetization curves for the sinters prepared in Examples 5 and 6 are also shown in FIG. 1.

The above results show that the sinters prepared in accordance with the present invention by coating magnetic crystal grains with a C-containing protective film experienced very small degrees of demagnetization over a prolonged period, indicating their great ability to resist oxidation. This effect was reasonably displayed by the sample prepared in Example 6 which contained 3 at.% B, but particularly good results were attained when the B content was less than 2 at.% as in the samples that were prepared in Examples 1 and 5 and depicted in FIG. 1.

EXAMPLES 7-10

Additional sinters were prepared by repeating the procedure of Example 1 except that carbon black was further added just before the pulverization step in order to provide the carbon contents shown in Table 1. In Example 7, carbon black was not added to the starting materials to be melted but it was totally added just before the pulverization step.

COMPARATIVE EXAMPLE 3

A sinter was prepared by repeating the procedure of Comparative Example 1 except that the starting materials were weighed and mixed to provide a composition designated by 18Nd/81Fe/1B (at.%).

COMPARATIVE EXAMPLE 4

A sinter was prepared by repeating the procedure of the above examples except that the starting materials were weighed and mixed to provide a composition designated by 18Nd/56Fe/1B/25C.

The oxidation resistance of each sinter, the C content of the protective film, the size of magnetic crystal grains, the thickness of the protective film and the magnetic characteristics of each sinter were evaluated as in Example 1 and the results are shown in Table 1.

As the data in Table 1 shows, all the sinters that satisfied the requirements of the present invention for alloy composition (at. percent) and protective film experienced small degrees of demagnetization and displayed high oxidation resistance. The sample prepared in Comparative Example 3 did not contain carbon in the protective film, so it rusted too heavily to justify the measurement of oxidation resistance. The sample prepared in Comparative Example 4 contained such a great amount of carbon in the protective film that the value of Br was undesirably low.

TABLE 1

| Example | Composition | Oxidation Resistance (%) ΔBr | ΔiHc | Br (kG) | iHc (kOe) | (BH)max (MGOe) | C content in Protective Film (wt. %) | Thickness of Protective Film (μm) | Size of Magnetic Crystal Grains (μm) |
|---|---|---|---|---|---|---|---|---|---|
| 1 | 18Nd—71Fe—1B—10C | −0.36 | −0.10 | 10.7 | 9.9 | 27.3 | 6.1 | 0.010-5.6 | 0.7-25 |
| 2 | 18Nd—17.9Fe—0.1B—10C | −0.17 | −0.02 | 7.4 | 5.4 | 10.4 | 5.6 | 0.007-5.1 | 0.7-15 |
| 3 | 18Nd—71.5Fe—0.5B—10C | −0.23 | −0.05 | 8.7 | 7.3 | 16.8 | 5.8 | 0.008-6.3 | 1.0-17 |
| 4 | 18Nd—70.5Fe—1.5B—10C | −0.38 | −0.26 | 11.7 | 10.4 | 32.5 | 6.5 | 0.010-5.7 | 1.4-23 |
| 5 | 18Nd—70.1Fe—1.9B—10C | −0.42 | −0.48 | 11.9 | 9.2 | 29.6 | 6.7 | 0.006-5.3 | 1.5-25 |
| 6 | 18Nd—69Fe—3B—10C | −1.02 | −2.30 | 12.1 | 8.6 | 27.6 | 7.4 | 0.017-6.4 | 2.0-32 |
| Comparative Example 1 | 18Nd—76Fe—6B | measurement impossible | | 10.8 | 10.2 | 32.0 | — | — | 2.8-35 |

TABLE 1-continued

| Example | Composition | Oxidation Resistance (%) ΔBr | ΔiHc | Br (kG) | iHc (kOe) | (BH)max (MGOe) | C content in Protective Film (wt. %) | Thickness of Protective Film (μm) | Size of Magnetic Crystal Grains (μm) |
|---|---|---|---|---|---|---|---|---|---|
| Comparative Example 2 | 18Nd—72Fe—0B—10C | — | — | 0 | 0 | 0 | 5.5 | 0.15-5.2 | 0.4-14 |
| 7 | 18Nd—80Fe—1B—1C | −0.39 | −0.42 | 7.1 | 4.3 | 7.1 | 0.7 | 0.008-5.6 | 2.2-35 |
| 8 | 18Nd—76Fe—1B—5C | −0.26 | −0.39 | 11.8 | 8.8 | 34.0 | 3.0 | 0.009-6.9 | 1.8-25 |
| 9 | 18Nd—66Fe—1B—15C | −0.22 | −0.22 | 9.1 | 10.3 | 17.3 | 9.5 | 0.011-4.9 | 1.4-17 |
| 10 | 18Nd—61Fe—1B—20C | −0.21 | −0.19 | 7.3 | 10.4 | 10.2 | 13.0 | 0.008-5.3 | 1.1-13 |
| Comparative Example 3 | 18Nd—81Fe—1B—0C | measurement impossible | | 6.3 | 0.8 | 0.7 | — | — | 2.8-35 |
| Comparative Example 4 | 18Nd—56Fe—1B—25C | −0.20 | −0.08 | 5.8 | 10.5 | 7.6 | 21.3 | 0.012-7.2 | 0.8-11 |

EXAMPLES 11-13

Sinters were prepared by repeating the procedure of Example 1 except that the starting materials were weighed and mixed to provide the neodymium contents shown in Table 2.

The oxidation resistance of each sinter, the C content of the protective film, the size of magnetic crystal grains, the thickness of the protective film and the magnetic characteristics of each sinter were evaluated as in Example 1 and the results are shown in Table 2.

As the data in Table 2 shows, the sinters of the present invention had excellent magnetic characteristics and their resistance to oxidation was also very satisfactory.

EXAMPLES 14-22

Additional sinters were prepared by repeating the procedure of Example 1 except that the neodymium added to the starting materials to be melted was replaced by other rare-earth elements as set forth in Table 2.

The oxidation resistance of each sinter, the C content of the protective film, the size of magnetic crystal grains, the thickness of the protective film and the magnetic characteristics of each sinter were evaluated as in Example 1 and the results are shown in Table 2.

As the data in Table 2 shows, the sintered magnets of the present invention had excellent magnetic characteristics and their resistance to oxidation was also very satisfactory.

EXAMPLE 23

A sinter was prepared by repeating the procedure of Example 1 except that the fine alloy powder was compacted in the absence of an applied magnetic field.

The oxidation resistance of the sinter, the C content of the protective film, the size of magnetic crystal grains, the thickness of the protective film and the magnetic characteristics of the sinter were evaluated as in Example 1 and the results are shown in Table 2.

EXAMPLES 23a-23d

A sinter was prepared by repeating the procedure of Example 1 except that the starting materials were weighed and mixed to provide the neodymium contents shown in Table 2.

The oxidation resistance of the sinter, the C content of the protective film, the size of magnetic crystal grains, the thickness of the protective film and the magnetic characteristics of the sinter were evaluated as in Example 1 and the results are shown in Table 2.

TABLE 2

| Example | Composition | Oxidation Resistance (%) ΔBr | ΔiHc | Br (kG) | iHc (kOe) | (BH)max (MGOe) | C content in Protective Film (wt. %) | Thickness of Protective Film (μm) | Size of Magnetic Crystal Grains (μm) |
|---|---|---|---|---|---|---|---|---|---|
| 11 | 10Nd—79Fe—1B—10C | −0.09 | −0.05 | 8.5 | 4.5 | 10.3 | 6.8 | 0.007-3.2 | 1.6-35 |
| 12 | 20Nd—69Fe—1B—10C | −0.12 | −0.06 | 10.1 | 10.9 | 25.3 | 6.0 | 0.01-8.3 | 1.4-17 |
| 13 | 30Nd—59Fe—1B—10C | −0.32 | −0.32 | 7.6 | 13.7 | 11.2 | 5.4 | 0.009-14.1 | 0.9-13 |
| 14 | 18Pr—71Fe—1B—10C | −0.20 | −0.24 | 10.5 | 9.3 | 25.6 | 6.1 | 0.01-5.2 | 2.0-22 |
| 15 | 8Pr—10Nd—71Fe—1B—10C | −0.33 | −0.18 | 10.5 | 9.3 | 25.6 | 5.9 | 0.008-5.3 | 1.6-22 |
| 16 | 8La—10Nd—71Fe—1B—10C | −0.26 | −0.25 | 10.0 | 8.5 | 19.8 | 6.3 | 0.009-4.9 | 1.2-18 |
| 17 | 8Ce—10Nd—71Fe 1B—10C | −0.39 | −0.19 | 10.3 | 9.6 | 21.5 | 6.0 | 0.013-5.5 | 0.8-16 |
| 18 | 8Sm—10Nd—71Fe—1B—10C | −0.26 | −0.11 | 10.7 | 6.4 | 25.1 | 6.1 | 0.011-5.6 | 2.5-26 |
| 19 | 8Dy—10Nd—71Fe 1B—10C | −0.28 | −0.26 | 9.2 | 21.0 | 27.1 | 6.3 | 0.008-5.1 | 1.3-15 |
| 20 | 8Tb—10Nd—71Fe 1B—10C | −0.22 | −0.22 | 8.5 | 13.2 | 18.3 | 5.8 | 0.012-5.9 | 1.6-13 |

TABLE 2-continued

| Example | Composition | Oxidation Resistance (%) ΔBr | ΔiHc | Br (kG) | iHc (kOe) | (BH)max (MGOe) | C content in Protective Film (wt. %) | Thickness of Protective Film (μm) | Size of Magnetic Crystal Grains (μm) |
|---|---|---|---|---|---|---|---|---|---|
| 21 | 8Er—10Nd—71Fe 1B—10C | −0.18 | −0.20 | 9.8 | 10.5 | 23.8 | 6.1 | 0.008-6.0 | 2.0-17 |
| 22 | 8Y—10Nd—71Fe—1B—10C | −0.30 | −0.18 | 7.5 | 8.3 | 10.7 | 6.2 | 0.008-5.4 | 2.2-20 |
| 23 | 18Nd—71Fe—1B—10C | −0.31 | −0.08 | 6.2 | 11.3 | 9.2 | 5.8 | 0.012-6.4 | 1.2-19 |
| 23a | 18Nd—76Fe—1B—5C | −0.33 | −0.36 | 7.0 | 9.8 | 9.2 | 1.6 | 0.011-7.3 | 1.8-35 |
| 23b | 18Nd—80Fe—1B—1C | −0.41 | −0.41 | 5.9 | 5.2 | 6.4 | 0.7 | 0.007-7.6 | 2.5-58 |
| 23c | 18Nd—80.5Fe—1B—0.5C | −0.46 | −0.44 | 5.7 | 4.1 | 5.0 | 0.2 | 0.008-11.8 | 2.6-118 |
| 23d | 30Nd—68Fe—1B—1C | −0.46 | −0.61 | 4.8 | 5.6 | 5.7 | 0.4 | 0.01-25.5 | 1.4-47 |

The following examples are provided for the purpose of further illustrating the characteristics of the magnet of the present invention which has a protective film containing C and Co.

EXAMPLE 24

Starting materials, which consisted of 99.9% pure electrolytic iron, 99.5% pure eletrolytic cobalt, a ferroboron alloy with a boron content of 19.32%, 99.5% pure carbon black, and a 98.5% pure neodymium metal containing other rare-earth elements as impurities, were weighed and mixed in such proportions that a composition designated by 18Nd/56Fe/10Co/1B/3C (at. %) would be obtained. The mixture was melted under vacuum in high-frequency induction furnace and thereafter cast into a water-cooled copper mold to form an alloy ingot. The thus obtained alloy ingot was crushed into particles of 10-15 mm in size with a jaw crusher and subsequently held at 700° C. for 5 h, followed by cooling at a rate of 50° C./min. The crushed ingot was then coarsely ground to a size of −100 mesh with a stamp mill in an argon gas. Thereafter, 99.5% pure carbon black and 99.5% pure electrolytic cobalt powder were added to the coarsely ground ingot in such an amount that a composition designated by 18Nd/56Fe/15Co/1B/10C (at. %) would be obtained. Then, the mixture was finely ground to an average particle size of 5 μm by means of a vibrating mill. The thus obtained alloy powder was compacted at a pressure of 1 ton/cm$^2$ in a magnetic field of 10 kOe, held in an argon gas at 1,100° C. for 1 h and subsequently quenched to obtain a sinter.

COMPARATIVE EXAMPLE 5

A sample was prepared by repeating the procedure of Example 24 except that no carbon black was used and starting materials were weighed and mixed to provide a composition designated by 18Nd/61Fe/15Co/6B (at. %). The mixture was subsequently treated as in Example 24, i.e., it was melted (in the absence of carbon black), coarsely ground, pulverized, compacted in a magnetic field, sintered and quenched to obtain a sinter.

In order to evaluate the oxidation resistance of the sinters, they were subjected to a weathering test in which they were left to stand in a hot and humid atmosphere (60° C.×90% RH) for 7 months (5,040 h). Demagnetization (drop in Br and iHc) data and curves for the respective sinters are shown in Table 3 and FIG. 5, respectively.

Figure 5:
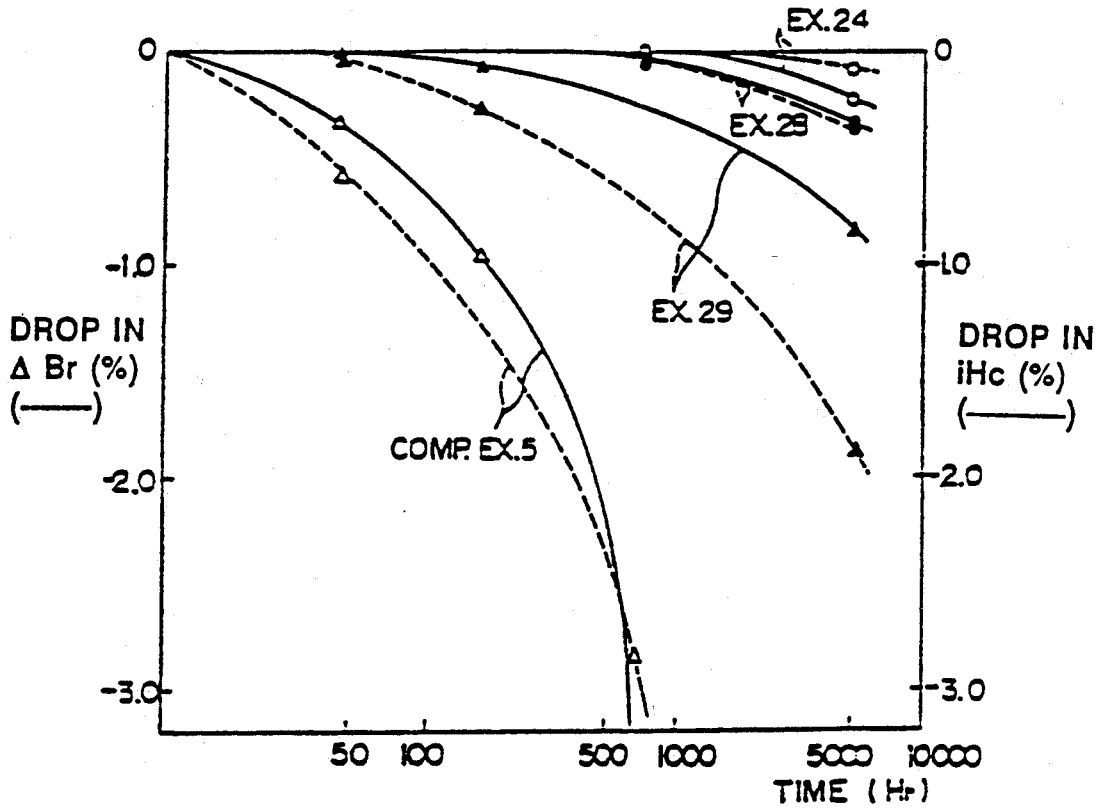
FIG. 5 shows demagnetization curves of Br and iHc for the sintered magnets of the present invention having magnetic crystal grains covered by the C- and Co-containing oxidation-resistant protective film (Example 24, 28 and 29) and those for the sintered magnets of the prior art having no such protective layer (Comparative Example 5) when they were left to stand at 60° C. and 90% RH.

As is clear from FIG. 5, the sinter prepared according to the present invention in Example 24 by coating magnetic crystal grains with a C- and Co-containing protective film experienced very small degrees of demagnetization (−0.23% in Br, and −0.09% in iHc) after 7 months, showing that said sinter had very high resistance to oxidation. On the other hand, the sinter prepared in Comparative Example 5 which was not protected by a C-containing film experienced significant demagnetization (−7.8% in Br and −2.4% in iHc) only after 1 month (720 h) and upon further standing, it rusted so heavily that Br and iHc measurements were impossible.

Figure 6:
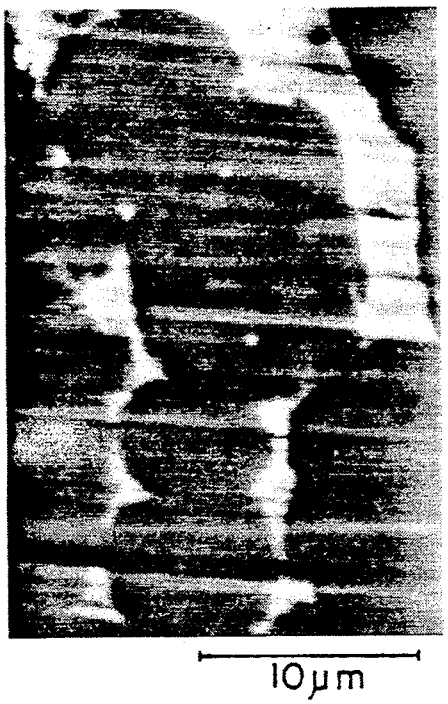
FIG. 6 is an electron micrograph showing the metallic structure of the magnet of the present invention prepared in Example 24.
Figure 7:
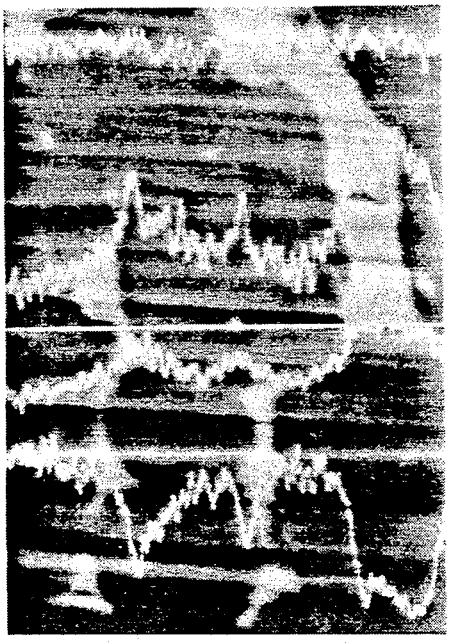
FIG. 7 is a photo showing the result of spectral line analyses for Nd, Co, Fe and C elements in the metallic structure shown in FIG. 6.
Figure 8:
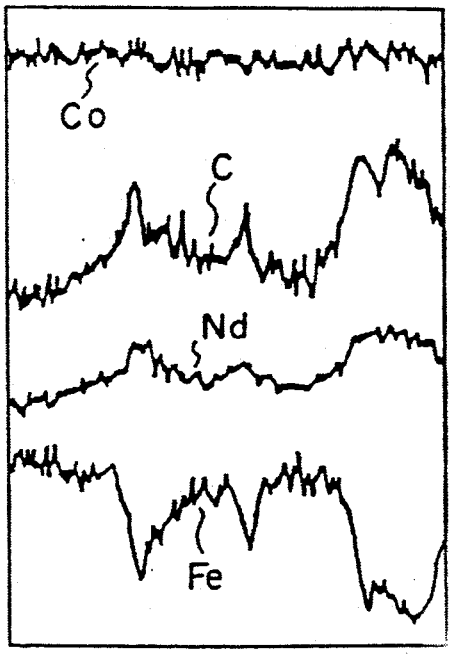
FIG. 8 is a diagram showing the spectral lines of the respective elements as reproduced from FIG. 7.

FIG. 6 is a SEM micrograph showing the microstructure of the sinter of Example 24. The same sinter was subjected to spectral line analyses for C, Co and Nd elements with EPMA and the result is shown in photo in FIG. 7. FIG. 8 shows spectral lines for the respective elements as reproduced from the photo of FIG. 7. These pictures clearly show that the magnetic crystal grains are covered with a C- and Co-containing oxidation-resistant protective film and that the greater part of C is present in the Nd-rich portion of this protective film. The C content of the protective film was 6.2 wt % and the Co content of the same film was 21.9 wt %. The size of magnetic crystal grains was measured for 100 grains selected from the SEM micrograph showing the microstructure of the sinter and it was found to be within the range of 0.7-25 μm. The thickness of the protective film as measured with TEM was 0.009-5.4 μm. The values of grain size and film thickness are also shown in Table 3.

Magnetization measurements were conducted with a vibrating-sample magnetometer (VSM) and the values of Br, iHc and (BH)max thus measured are shown in Table 3.

As the above results show, the permanent magnet alloy of the present invention is much more resistant to oxidation than the known sample of Comparative Example 5, and the magnetic characteristics of this alloy are comparable to or better than those of the known sample.

EXAMPLES 25-29

Sinters were prepared by repeating the procedure of Example 24 except that the starting materials to be melted were weighed and mixed to provide the boron (B) contests shown in Table 3.

COMPARATIVE EXAMPLE 6

A sinter was prepared by the same procedure except that no boron was incorporated (B=0 at. %).

The oxidation resistance of each sinter, the C and Co contents of the protective film, the size of magnetic crystal grains, the thickness of the protective film and the magnetic characteristics of each sinter were evaluated as in Example 24 and the results are shown in Table 3. Demagnetization curves for the sinters prepared in Examples 28 and 29 are also shown in FIG. 5.

The above results show that the sinters prepared in accordance with the present invention by coating magnetic crystal grains with a C- and Co-containing protective film experienced very small degrees of demagnetization over a prolonged period, indicating their great ability to resist oxidation. This effect was reasonably displayed by the sample prepared in Example 29 which contained 3 at. % B, but particularly goo results were attained when the B content was less than 2 at. % as in the samples that were prepared in Examples 24 and 28.

EXAMPLES 30–33

Additional sinters were prepared by repeating the procedure of Example 24 except that carbon black was further added just before the pulverization step in order to provide the carbon contents shown in Table 3. In Example 30, carbon black was not added to the starting materials to be melted but it was totally added just before the pulverization step.

COMPARATIVE EXAMPLE 7

A sinter of the composition as shown in Table 3 was prepared by repeating the procedure of Comparative Example 5 except that the starting materials were weighed and mixed to provide a composition designated by 18Nd/66Fe/15Co/1B/0C (at. %).

COMPARATIVE EXAMPLE 8

A sinter was prepared by repeating the procedure of the above examples except that the starting materials were weighed and mixed to provide a composition designated by 18Nd/41Fe/15Co/1B/25C.

The oxidation resistance of each sinter, the C and Co contents of the protective film, the size of magnetic crystal grains, the thickness of the protective film and the magnetic characteristics of each sinter were evaluated as in Example 24 and the results are shown in Table 3.

As the data in Table 3 shows, all the sinters that satisfied the requirements of the present invention for alloy composition (at. percent) and protective film experienced small degrees of demagnetization and displayed high oxidation resistance. The sample prepared in Comparative Example 7 did not contain carbon in the protective film, so it rusted too heavily to justify the measurement of oxidation resistance. The sample prepared in Comparative Example 8 contained such a great amount of carbon in the protective film that the value of Br was undesirably low.

EXAMPLES 34–36

Sinters were prepared by repeating the procedure of Example 24 except that the starting materials were weighed and mixed to provide the neodymium contents shown in Table 3.

The oxidation resistance of each sinter, the C and Co contents of the protective film, the size of magnetic crystal grains, the thickness of the protective film and the magnetic characteristics of each sinter were evaluated as in Example 24 and the results are shown in Table 3.

As the data in Table 3 shows, the sinters of the present invention had excellent magnetic characteristics and their resistance to oxidation was also very satisfactory.

TABLE 3

| Example | Composition | Oxidation Resistance (%) ΔBr | Oxidation Resistance (%) ΔiHc | Br (kG) | iHc (kOe) | (BH)max (MGOe) | Content in Protective Film (wt. %) Co | Content in Protective Film (wt. %) C | Thickness of Protective Film (μm) | Size of Magnetic Crystal Grains (μm) |
|---|---|---|---|---|---|---|---|---|---|---|
| 24 | 18Nd—56Fe—15Co—1B—10C | −0.23 | −0.09 | 11.0 | 10.9 | 29.1 | 21.9 | 6.2 | 0.009–5.4 | 0.7–25 |
| 25 | 18Nd—56.9Fe—15Co—0.1B—10C | −0.14 | −0.02 | 7.6 | 6.0 | 11.1 | 21.7 | 5.3 | 0.008–5.3 | 0.8–17 |
| 26 | 18Nd—56.5Fe—15Co—0.5B—10C | −0.19 | −0.04 | 8.9 | 8.1 | 17.9 | 21.8 | 5.7 | 0.010–5.8 | 1.2–19 |
| 27 | 18Nd—55.5Fe—15Co—1.5B—10C | −0.31 | −0.21 | 12.0 | 11.6 | 34.7 | 21.9 | 6.7 | 0.012–5.2 | 1.6–26 |
| 28 | 18Nd—55.1Fe—15Co—1.9B—10C | −0.34 | −0.37 | 12.2 | 10.2 | 31.7 | 22.0 | 7.1 | 0.010–5.2 | 1.6–28 |
| 29 | 18Nd—54Fe—15Co—3B—10C | −0.85 | −1.90 | 12.4 | 9.6 | 29.5 | 22.1 | 8.1 | 0.016–5.8 | 2.2–32 |
| Comparative Example 5 | 18Nd—61Fe—15Co—6B | measurement impossible | | 10.2 | 6.8 | 29.0 | 21.3 | — | — | 3.0–39 |
| Comparative Example 6 | 18Nd—57Fe—15Co—0B—10C | — | — | 0 | 0 | 0 | 22.0 | 5.2 | 0.12–5.4 | 0.4–16 |
| 30 | 18Nd—65Fe—15Co—1B—1C | −0.30 | −0.34 | 7.3 | 4.8 | 10.0 | 20.7 | 0.6 | 0.008–5.6 | 2.4–37 |
| 31 | 18Nd—61Fe—15Co—1B—5C | −0.21 | −0.31 | 12.1 | 9.8 | 34.8 | 21.2 | 1.4 | 0.009–5.4 | 1.9–28 |
| 32 | 18Nd—51Fe—15Co—1B—15C | −0.19 | −0.12 | 9.4 | 11.4 | 18.5 | 22.6 | 11.3 | 0.012–6.4 | 1.6–19 |
| 33 | 18Nd—46Fe—15Co—1B—20C | −0.17 | −0.15 | 7.5 | 11.6 | 10.9 | 23.4 | 15.6 | 0.009–5.3 | 1.2–15 |
| Comparative Example 7 | 18Nd—66Fe—15Co—1B—0C | measurement impossible | | 6.5 | 0.5 | 0.2 | 19.6 | — | — | 3.0–36 |

TABLE 3-continued

| Example | Composition | Oxidation Resistance (%) ΔBr | ΔiHc | Br (kG) | iHc (kOe) | (BH)max (MGOe) | Content in Protective Film (wt. %) Co | C | Thickness of Protective Film (μm) | Size of Magnetic Crystal Grains (μm) |
|---|---|---|---|---|---|---|---|---|---|---|
| Comparative Example 8 | 18Nd—41Fe—15Co—1B—25C | −0.16 | −0.08 | 5.3 | 10.8 | 7.4 | 24.2 | 22.5 | 0.007-5.6 | 0.9—13 |
| 34 | 10Nd—64Fe—15Co—1B—10C | −0.07 | −0.04 | 8.7 | 5.0 | 10.3 | 24.4 | 6.5 | 0.005-3.8 | 1.7-39 |
| 35 | 20Nd—54Fe—15Co—1B—10C | −0.10 | −0.05 | 10.4 | 12.1 | 27.0 | 21.3 | 6.1 | 0.010-7.9 | 1.6-19 |
| 36 | 30Nd—44Fe—15Co—1B—10C | −0.25 | −0.26 | 7.8 | 15.2 | 12.4 | 18.9 | 5.9 | 0.009-13.9 | 1.1-15 |

EXAMPLES 37-41

Sinters were prepared by repeating the procedure of Example 24 except that electrolytic cobalt powder was added just before the pulverization step in order to provide the cobalt contents shown in Table 4. In Examples 37, 38 and 39 cobalt was added only in the above-mentioned step, i.e., no cobalt was added in the melting step.

COMPARATIVE EXAMPLE 9

A sinter was prepared by repeating the procedure of Comparative Example 5 except that the starting materials were weighed and mixed to provide a composition designated by 18Nd/26Fe/45Co/1B/10C.

The oxidation resistance of each sinter, the C and Co contents of the protective film, the size of magnetic crystal grains, the thickness of the protective film and the magnetic characteristics of each sinter were evaluated as in Example 24 and the results are shown in Table 4.

As the data in Table 4 shows, the sintered magnets of the present invention had excellent magnetic characteristics and their resistance to oxidation was also very satisfactory.

In contrast, the amount of Co contained in the protective film (and the total amount of Co contained in the magnet) of the sample prepared in Comparative Example 9 was out of the range defined by the present invention. As a result, the magnetic characteristics represented by iHc, (BH)max, etc., were undesirably low.

EXAMPLES 42-50

A sinter was prepared by repeating the procedure of Example 24 except that neodymium used in the step of melting raw materials was replaced with the rare-earth element shown in Table 4.

The oxidation resistance of the sinter, the C and Co contents of the protective film, the size of magnetic crystal grains, the thickness of the protective film and the magnetic characteristics of the sinter were evaluated as in Example 24 and the results are shown in Table 4.

As the data in Table 4 shows, the sintered magnet of the present invention had excellent magnetic characteristics and their resistance to oxidation was also very satisfactory.

EXAMPLE 51

A sinter was prepared by repeating the procedure of Example 24 except that the fine alloy powder was compacted in the absence of an applied magnetic field.

The oxidation resistance of the sinter, the C and Co contents of the protective film, the size of magnetic crystal grains, the thickness of the protective film and the magnetic characteristics of the sinter were evaluated as in Example 24 and the results are shown in Table 4.

EXAMPLE 51a-51d

Sinters were prepared by repeating the procedure of Example 24 except that the starting materials were weighed and mixed to provide the compositions which would have the neodymium content and the C content as shown in Table 4.

The oxidation resistance of the sinter, the C and Co contents of the protective film, the size of magnetic crystal grains, the thickness of the protective film and the magnetic characteristics of the sinter were evaluated as in Example 24 and the results are shown in Table 4.

TABLE 4

| Example | Composition | Oxidation Resistance (%) ΔBr | ΔiHc | Br (kG) | iHc (kOe) | (BH)max (MGOe) | Content in Protective Film (wt. %) Co | C | Thickness of Protective Film (μm) | Size of Magnetic Crystal Grains (μm) |
|---|---|---|---|---|---|---|---|---|---|---|
| 37 | 18Nd—70Fe—1Co—1B—10C | −0.34 | −0.10 | 10.8 | 10.5 | 29.9 | 4.4 | 6.2 | 0.008-5.6 | 1.2-21 |
| 38 | 18Nd—66Fe—5Co—1B—10C | −0.32 | −0.11 | 11.1 | 11.5 | 31.3 | 22.0 | 6.3 | 0.010-4.8 | 1.4-19 |
| 39 | 18Nd—61Fe—10Co—1B—10C | −0.26 | −0.08 | 11.1 | 11.7 | 32.3 | 25.2 | 6.2 | 0.012-5.3 | 1.5-21 |
| 40 | 18Nd—51Fe—20Co—1B—10C | −0.21 | −0.05 | 10.5 | 9.5 | 27.9 | 24.8 | 6.1 | 0.009-5.6 | 2.1-28 |
| 41 | 18Nd—41Fe—30Co—1B—10C | −0.18 | −0.03 | 9.6 | 6.0 | 19.8 | 28.3 | 6.2 | 0.010-5.3 | 2.9-31 |
| Comparative Example 9 | 18Nd—26Fe—45Co—1B—10C | −0.09 | −0.02 | 9.0 | 3.2 | 2.6 | 47.9 | 6.1 | 0.015-5.6 | 3.5-45 |
| 42 | 18Pr—56Fe—15Co—1B—10C | −0.16 | −0.19 | 10.8 | 10.3 | 27.4 | 20.8 | 5.9 | 0.010-5.3 | 2.2-25 |

TABLE 4-continued

| Example | Composition | Oxidation Resistance (%) ΔBr | ΔiHc | Br (kG) | iHc (kOe) | (BH)max (MGOe) | Content in Protective Film (wt. %) Co | C | Thickness of Protective Film (μm) | Size of Magnetic Crystal Grains (μm) |
|---|---|---|---|---|---|---|---|---|---|---|
| 43 | 8Pr—10Nd—56Fe—15Co—1B—10C | −0.20 | −0.14 | 10.8 | 10.3 | 27.4 | 21.6 | 5.7 | 0.009-5.4 | 1.8-24 |
| 44 | 8La—10Nd—56Fe—15Co—1B—10C | −0.20 | −0.20 | 10.4 | 9.4 | 21.2 | 20.6 | 6.1 | 0.012-5.6 | 1.4-21 |
| 45 | 8Ce—10Nd—56Fe—15Co—1B—10C | −0.31 | −0.15 | 10.6 | 10.7 | 23.0 | 22.3 | 5.8 | 0.013-5.3 | 1.1-18 |
| 46 | 8Sm—10Nd—56Fe—15Co—1B—10C | −0.21 | −0.09 | 11.0 | 7.1 | 26.8 | 21.7 | 5.9 | 0.010-5.8 | 2.6-29 |
| 47 | 8Dy—10Nd—56Fe—15Co—1B—10C | −0.22 | −0.20 | 9.6 | 22.0 | 29.0 | 20.2 | 6.1 | 0.008-5.1 | 1.5-17 |
| 48 | 8Tb—10Nd—56Fe—15Co—1B—10C | −0.17 | −0.17 | 8.7 | 14.7 | 19.6 | 21.0 | 5.6 | 0.009-5.8 | 1.7-15 |
| 49 | 8Er—10Nd—56Fe—15Co—1B—10C | −0.14 | −0.16 | 10.1 | 11.7 | 25.5 | 20.8 | 5.9 | 0.012-5.4 | 2.1-19 |
| 50 | 8Y—10Nd—56Fe—15Co—1B—10C | −0.24 | −0.14 | 7.7 | 9.2 | 11.1 | 20.3 | 6.0 | 0.009-5.5 | 2.8-23 |
| 51 | 18Nd—56Fe—15Co—1B—10C | −0.25 | −0.07 | 6.7 | 11.8 | 9.7 | 21.5 | 6.0 | 0.010-6.0 | 1.3-23 |
| 51a | 18Nd—61Fe 15Co—1B—5C | −0.26 | −0.29 | 7.2 | 10.8 | 9.8 | 20.8 | 1.4 | 0.009-6.9 | 1.9-39 |
| 51b | 18Nd—65Fe—15Co—1B—1C | −0.33 | −0.33 | 6.1 | 5.8 | 6.8 | 20.3 | 0.5 | 0.011-7.1 | 2.6-62 |
| 51c | 18Nd—65.5Fe—15Co—1B—0.5C | −0.36 | −0.35 | 5.9 | 4.5 | 5.3 | 2.01 | 0.2 | 0.009-10.2 | 2.7-112 |
| 51d | 30Nd—53Fe—15Co—1B—1C | −0.37 | −0.49 | 4.9 | 6.2 | 6.1 | 18.6 | 0.3 | 0.011-25.2 | 1.5-51 |

The advantage of the present invention will be shown below by referring to the representative examples of the process of the present invention.

EXAMPLE 52

Starting materials, which consisted of 99.9% pure electrolytic iron, a ferroboron alloy with a boron content of 19.32%, 99.5% pure carbon black, and a 98.5% pure neodymium metal containing other rare-earth elements as impurities, were weighed and mixed in such proportions that a composition designated by 18Nd/76Fe/3B/3C would be obtained. The mixture was melted under vacuum in high-frequency induction furnace and thereafter cast into a water-cooled copper mold to form an alloy ingot.

The thus obtained alloy ingot was heat treated at 800° C. for 15 h and then was held to stand in a furnace for cooling.

Then, the alloy ingot was crushed into particles with a jaw crusher and was then coarsely ground to a size of −100 mesh with a stamp mill in an argon gas and was further finely ground to an average particle size of 5 μm by means of a vibrating mill. The thus obtained alloy powder was compacted at a pressure of 1 ton/cm$^2$ in a magnetic field of 10 kOe.

The resulting shaped product was held in an argon gas at 1,100° C. for 1 h and subsequently quenched to obtain a sinter.

COMPARATIVE EXAMPLE 10

A sinter was prepared by repeating the procedure of Example 52 except that the heat treatment of the alloy ingot was omitted.

In order to evaluate the oxidation resistance of the sinters obtained in Example 52 and in Comparative Example 10, they were subjected to an evaluation test for determining the oxidation resistance (a weathering test). This test was carried out by leaving the samples to stand in a hot and humid atmosphere (60° C.×90% RH) for 7 months (5,040 h) and then measuring the demagnetization (drop in Br and iHc). The results are shown in Table 5 and FIG. 9.

Figure 9:
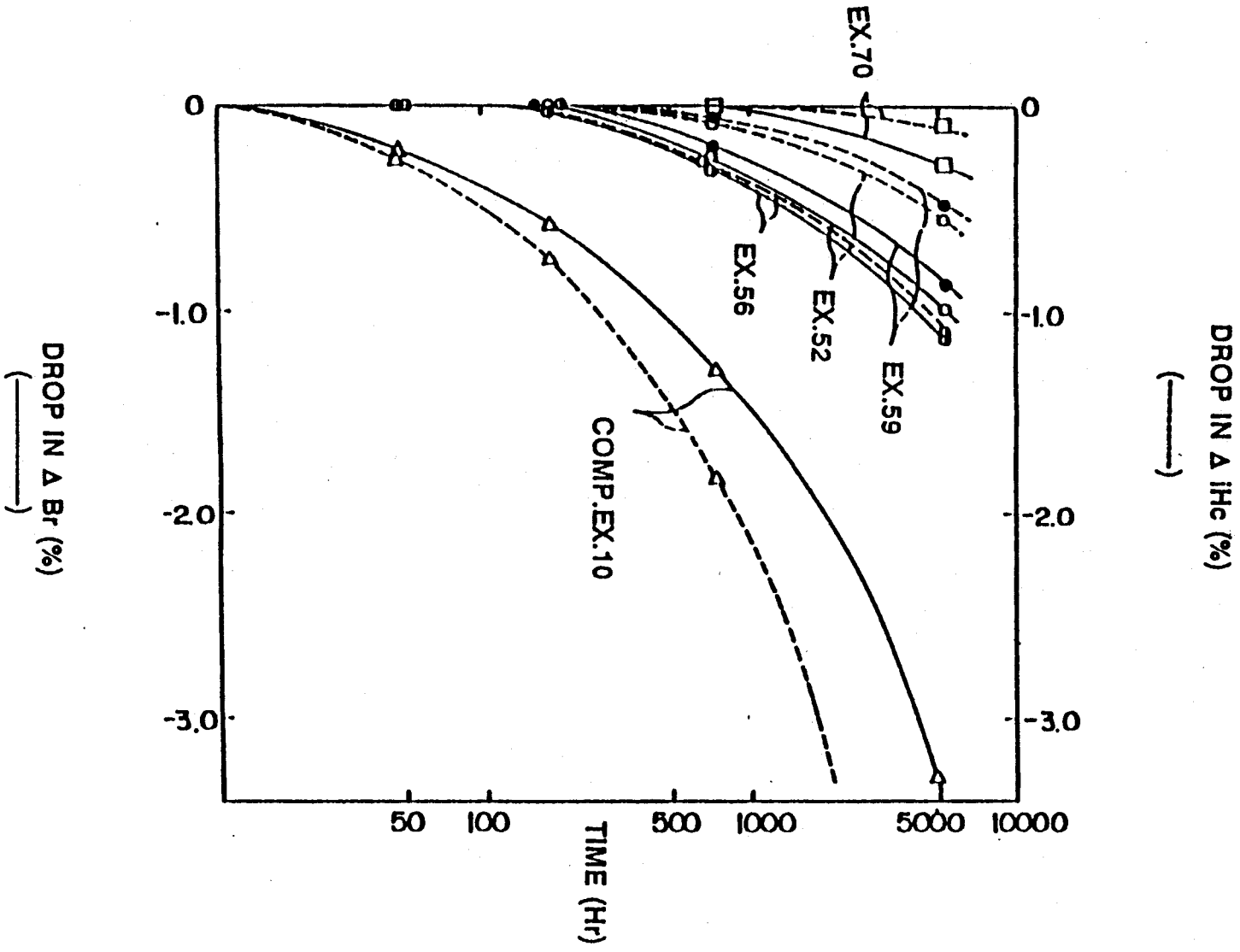
FIG. 9 shows demagnetization curves of Br and iHc for the sintered magnets of the present invention having magnetic crystal grains covered with the C-containing oxidation-resistant protective film (Examples 52, 56, 59 and 70) and those of the comparative samples having no such protective layer (Comparative Example 10) when they were left to stand at 60° C. and 90% RH with the surface of the magnets being exposed.

As is clear from FIG. 9 and Table 5, the sinter prepared in Example 52 experienced very small degrees of demagnetization as shown by −0.98% in Br, and −0.56% in iHc after 7 months. This shows that the oxidation resistance of this sinter has been remarkably improved. In contrast, the sinter prepared in Comparative Example 10 experienced significant demagnetization as shown by −3.27% in Br and −5.8% in iHc.

Demagnetization data of some other sinters prepared in the examples to be described hereinafter are also shown in FIG. 9.

Figure 10:
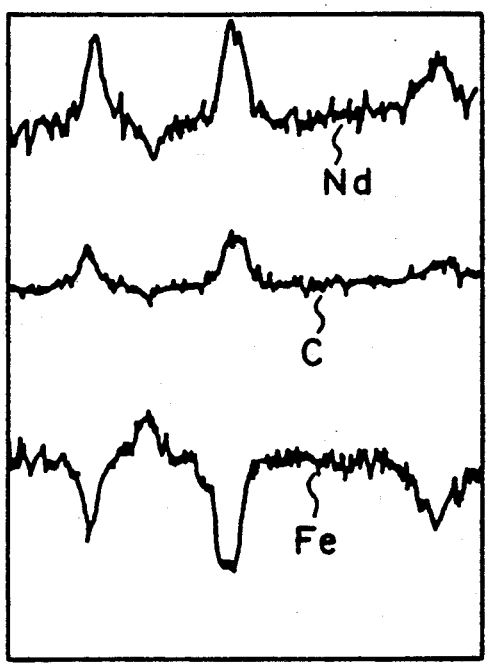
FIG. 10 is a diagram showing the spectral lines of the respective elements as reproduced from a photo showing the result of spectral line analyses for Nd, Fe and C elements in the metallic structure shown in an electron micrograph showing the metallic structure of the magnet of the present invention prepared in Example 52.

FIG. 10 shows spectral lines for the respective elements as reproduced from the photo of spectral line analyses for Fe, C and Nd elements with EPMA. These pictures clearly show that the magnetic crystal grains are covered with a C-containing oxidation-resistant protective film and that the greater part of C is present in the Nd-rich portion of this protective film. The C content of the protective film was 4.7 wt %. The size of magnetic crystal grains was measured for 100 grains selected from the SEM micrograph showing the microstructure of the sinter and it was found to be within the range of 1.8-21 μm. The thickness of the protective film as measured with TEM was 0.013-5.8 μm. These values are shown in Table 5 given hereinbelow. Magnetization measurements were conducted with a vibrating sample magnetometer (VSM) and the values of Br, iHc and (BH)max thus measured are shown in Table 5.

As the above results show, the permanent magnet alloy of the present invention is much more resistant to oxidation than the known sample of Comparative Example, and the magnetic characteristics of this alloy are comparable to or better than those of the known sample.

EXAMPLES 53-55

Sinters were prepared by repeating the procedure of Example 52 except that the heat treatment temperature of the alloy ingot and the holding time were, in the respective case, 600° C.×24 h (in Example 53), 1,000° C.×0.5 h (in Example 54) and 1,100° C.×0.5 h (in Example 55).

The oxidation resistance of each sinter, the C content of the protective film, the size of magnetic crystal grains, the thickness of the protective film and the magnetic characteristics of each sinter were evaluated as in Example 52 and the results are shown in Table 5.

EXAMPLE 56

Starting materials, which consisted of 99.9% pure electrolytic iron, a ferroboron alloy with a boron content of 19.32%, 99.5% pure carbon black and a 98.5% pure neodymium metal (containing other rare-earth elements as impurities), were weighed and mixed in such proportions that a composition designated by 18Nd/76Fe/3B/1C would be obtained. The mixture was melted under vacuum in a high-frequency induction furnace and thereafter cast into a water-cooled copper mold to form an alloy ingot.

The thus obtained alloy ingot was crushed with a jaw crusher and the crushed ingot was then coarsely ground to a size of −100 mesh with a stamp mill in an argon gas. Thereafter, 99.5% pure carbon black was added to the coarsely ground ingot in such an amount that a composition designated by 18Nd/76Fe/3B/3C would be obtained. Then, the mixture was finely ground to an average particle size of 5 μm by means of a vibrating mill.

The thus obtained alloy powder was compacted at a pressure of 1 ton/cm$^2$ in a magnetic field of 10 kOe, held in an argon gas at 1,100° C. for 1 h and subsequently quenched to obtain a sinter. With respect to the sinter thus obtained, the C content of the protective film, the size of magnetic crystal grains, the thickness of the protective film and the magnetic characteristics were evaluated as in Example 52 and the results are shown in Table 6.

EXAMPLES 57-58

Sinters were prepared by repeating the procedure of Example 56 except that the amount of carbon for the primary addition to be made in the melting stage and that for the secondary addition to be made either in the coarsely grinding stage or in the finely grinding stage were changed as shown in Table 6.

With respect to the sinters thus obtained, the C content of the protective film, the size of magnetic crystal grains, the thickness of the protective film and the magnetic characteristics were evaluated as in Example 52 and the results are shown in Table 6. The primary composition as given in Table 6 means the composition in the melting stage, and the secondary composition as given in the same table means that in the sintering stage.

EXAMPLE 59

Sinters were prepared by repeating the procedure of Example 56 except that the extra stage of subjecting the alloy ingot to heat treatment at 700° C. for 18 h was added. With respect to the sinters thus obtained, the oxidation resistance, the C content of the protective film, the size of magnetic crystal grains, the thickness of the protective film and the magnetic characteristics were evaluated as in Example 52 and the results are shown in Table 6.

EXAMPLES 60-66

Sinters were prepared by repeating the procedure of Example 52 except that the temperature of sintering, the holding time for sintering, the slow cooling rate after sintering and the temperature at which quenching was to start were changed as shown in Table 7. With respect to the sinters thus obtained, the oxidation resistance, the C content of the protective film, the size of magnetic crystal grains, the thickness of the protective film and the magnetic characteristics were evaluated as in Example 52 and the results are shown in Table 7.

EXAMPLES 67-69

The same procedure as in Example 52 was repeated except that sinters were subjected to the final heat treatment under the conditions as shown in Table 8. With respect to the sinters thus obtained, the oxidation resistance, the C content of the protective film, the size of magnetic crystal grains, the thickness of the protective film and the magnetic characteristics were evaluated as in Example 52 and the results are shown in Table 8.

TABLE 5

| Example | Composition | Conditions for Heat Treating Alloys: Temperature (°C.) | Time (hr) | Oxidation Resistance (%): ΔBr | ΔiHc | Br (kG) | iHc (kOe) | (BH)max (MGOe) | C Content in Protective Film (wt. %) | Thickness of Protective Film (μm) | Size of Magnetic Crystal Grains (μm) |
|---|---|---|---|---|---|---|---|---|---|---|---|
| 52 | 18Nd—76Fe—3B—3C | 800 | 15 | −0.98 | 0.56 | 11.9 | 11.6 | 31.8 | 4.7 | 0.013-5.8 | 1.8-21 |
| 53 | 18Nd—76Fe—3B—3C | 600 | 24 | −1.10 | −0.82 | 11.4 | 10.9 | 30.1 | 4.3 | 0.009-5.4 | 2.3-18 |
| 54 | 18Nd—76Fe—3B—3C | 1,000 | 0.5 | −0.96 | −1.01 | 11.2 | 11.5 | 29.8 | 4.5 | 0.008-5.4 | 1.6-26 |
| 55 | 18Nd—76Fe—3B—3C | 1,100 | 0.5 | −0.96 | −0.93 | 10.3 | 10.7 | 29.1 | 4.8 | 0.012-5.1 | 1.9-22 |
| Comparative Example 10 | 18Nd—76Fe—3B—3C | — | — | −3.27 | −5.80 | 9.2 | 10.1 | 23.8 | 2.1 | 0.017-5.9 | 1.8-21 |

TABLE 6

| Example | | 56 | 57 | 58 | 59 |
|---|---|---|---|---|---|
| Composition | 1st | 18Nd—76Fe—3B—1C | 18Nd—76Fe—3B—2C | 18Nd—76Fe—3B | 18Nd—76Fe—3B—1C |
| | 2nd | 18Nd—76Fe—3B—3C | 18Nd—76Fe—3B—3C | 18Nd—76Fe—3B—3C | 18Nd—76Fe—3B—3C |
| Conditions | Tempera- | — | — | — | 700 |

TABLE 6-continued

| Example | | 56 | 57 | 58 | 59 |
|---|---|---|---|---|---|
| for Heat Treating Alloys | ture (°C.) | | | | |
| | Time (hr) | — | — | — | 18 |
| Oxidation Resistance (%) | ΔBr | −1.12 | −1.28 | −0.98 | −0.86 |
| | ΔiHc | −1.09 | −2.15 | −0.87 | −0.47 |
| Br | (kG) | 10.8 | 10.5 | 11.7 | 11.8 |
| iHc | (kOe) | 10.7 | 10.5 | 11.3 | 11.4 |
| (BH)max | (MGOe) | 26.3 | 25.9 | 28.0 | 30.9 |
| C Content in Protective Film | (wt. %) | 5.2 | 4.8 | 6.7 | 5.8 |
| Thickness of Protective Film | (μm) | 0.009-5.3 | 0.008-5.5 | 0.012-5.1 | 0.009-5.2 |
| Size of Magnetic Crystal Grains | (μm) | 1.2-18 | 1.6-21 | 1.8-23 | 2.1-19 |

TABLE 7

| Example | | 60 | 61 | 62 | 63 |
|---|---|---|---|---|---|
| Composition | | 18Nd—76Fe—3B—3C | 18Nd—76Fe—3B—3C | 18Nd—76Fe—3B—3C | 18Nd—76Fe—3B—3C |
| Conditions for Sintering | Temperature (°C.) | 1,000 | 1,150 | 1,100 | 1,100 |
| | Time (hr) | 3.0 | 0.5 | 1.0 | 1.0 |
| Slow Cooling Rate | (°C./min.) | Quenching | Quenching | 1 | 10 |
| Starting Temperature of Quenching | (°C./min.) | 1,000 | 1,150 | 600 | 600 |
| Oxidation Resistance (%) | ΔBr | −0.98 | −0.83 | −0.72 | −0.73 |
| | ΔiHc | −0.83 | −0.67 | −0.51 | −0.56 |
| Br | (kG) | 11.4 | 11.3 | 12.4 | 12.1 |
| iHc | (kOe) | 11.6 | 11.7 | 11.8 | 11.2 |
| (BH)max | (MGOe) | 3.3 | 30.1 | 32.4 | 31.5 |
| C Content in Protective Film | (wt. %) | 4.5 | 4.7 | 4.1 | 3.9 |
| Thickness tive Film | (μm) | 0.008-5.3 | 0.013-5.8 | 0.011-5.6 | 0.010-5.7 |
| Size of Magnetic Crystal Grains | (μm) | 2.3-25 | 1.4-19 | 1.9-22 | 1.2-18 |

| Example | | 64 | 65 | 66 |
|---|---|---|---|---|
| Composition | | 18Nd—76Fe—3B—3C | 18Nd—76Fe—3B—3C | 18Nd—76Fe—3B—3C |
| Conditions for Sintering | Temperature (°C.) | 1,100 | 1,100 | 1,100 |
| | Time (hr) | 1.0 | 1.0 | 1.0 |
| Slow Cooling Rate | (°C./min.) | 20 | 10 | 10 |
| Starting Temperature of Quenching | (°C.min.) | 600 | 800 | 1,000 |
| Oxidation Resistance (%) | ΔBr | −0.82 | −0.76 | −0.80 |
| | ΔiHc | −0.60 | −0.56 | −0.66 |
| Br | (KG) | 11.9 | 11.7 | 11.5 |
| iHc | (KOe) | 11.3 | 11.7 | 11.2 |
| (BH)max | (MGOe) | 30.9 | 30.7 | 30.5 |
| C Content in Protective Film | (wt. %) | 3.7 | 4.6 | 4.5 |
| Thickness of Protective Film | (μm) | 0.013-5.8 | 0.009-5.4 | 0.008-5.7 |
| Size of Magnetic Crystal Grains | (μm) | 1.7-23 | 2.1-27 | 1.3-23 |

TABLE 8

| Example | Composition | Conditions for Final Heat Treatment Temperature (°C.) | Time (hr) | Oxidation Resistance (%) ΔBr | ΔiHc | Br (kG) | iHc (kOe) | (BH)max (MGOe) | C Content in Protective Film (wt. %) | Thickness of Protective Film (μm) | Size of Magnetic Crystal Grains (μm) |
|---|---|---|---|---|---|---|---|---|---|---|---|
| 67 | 18Nd—76Fe—3B—3C | 600 | 20 | −0.83 | −0.61 | 11.7 | 13.0 | 31.6 | 4.8 | 0.009-5.6 | 1.6-18 |
| 68 | 18Nd—76Fe—3B—3C | 800 | 10 | −0.85 | −0.58 | 11.8 | 13.5 | 31.3 | 4.5 | 0.012-5.3 | 2.2-22 |
| 69 | 18Nd—76Fe—3B—3C | 1,000 | 0.5 | −0.84 | −0.63 | 11.9 | 12.7 | 31.9 | 4.9 | 0.008-5.4 | 1.9-24 |

EXAMPLES 70-79

Sinters were prepared by repeating the procedure of Example 52 except that the compositions were changed as shown in Table 9. With respect to the sinters thus obtained, the oxidation resistance, the C content of the protective film, the size of magnetic crystal grains, the thickness of the protective film and the magnetic characteristics were evaluated as in Example 52 and the results are shown in Table 9.

EXAMPLE 80

Sinters were prepared by repeating the procedure of Example 52 except that the compaction of the alloy fine powder was conducted in the non-magnetic field. With respect to the sinters thus obtained, the oxidation resistance, the C content of the protective film, the size of magnetic crystal grains, the thickness of the protective film and the magnetic characteristics were evaluated as in Example 52 and the results are shown in Table 9.

TABLE 9

| Example | Composition | Oxidation Resistance (%) ΔBr | ΔiHc | Br (kG) | iHc (kOe) | (BH)max (MGOe) | C content in Protective Film (wt. %) | Thickness of Protective Film (μm) | Size of Magnetic Crystal Grains (μm) |
|---|---|---|---|---|---|---|---|---|---|
| 70 | 18Nd—71Fe—1B—10C | −0.28 | −0.09 | 10.9 | 10.7 | 28.6 | 6.4 | 0.008-5.2 | 1.4-29 |
| 71 | 18Pr—71Fe—1B—10C | −0.19 | −0.23 | 10.4 | 10.0 | 25.8 | 6.2 | 0.011-5.3 | 1.8-22 |
| 72 | 8Pr—10Nd—71Fe—1B—10C | −0.35 | −0.20 | 10.4 | 10.5 | 25.7 | 6.3 | 0.010-5.2 | 1.5-27 |
| 73 | 8La—10Nd—71Fe—1B—10C | −0.27 | −0.31 | 10.5 | 8.4 | 19.7 | 6.1 | 0.009-5.1 | 2.1-19 |
| 74 | 8Ce—10Nd—71Fe—1B—10C | −0.41 | −0.23 | 10.1 | 10.1 | 20.9 | 6.5 | 0.012-5.6 | 1.2-26 |
| 75 | 8Sm—10Nd—71Fe—1B—10C | −0.25 | −0.11 | 10.5 | 6.3 | 25.4 | 6.3 | 0.013-6.0 | 1.9-18 |
| 76 | 8Dy—10Nd—71Fe—1B—10C | −0.27 | −0.23 | 9.6 | 20.8 | 26.9 | 6.1 | 0.010-5.2 | 2.6-21 |
| 77 | 8Tb—10Nd—71Fe—1B—10C | −0.23 | −0.21 | 8.5 | 13.3 | 18.5 | 6.4 | 0.013-5.7 | 0.9-21 |
| 78 | 8Er—10Nd—71Fe—1B—10C | −0.19 | −0.18 | 9.6 | 10.7 | 22.9 | 6.0 | 0.011-5.3 | 1.7-28 |
| 79 | 8Y—10Nd—71Fe—1B—10C | −0.32 | −0.17 | 7.4 | 9.1 | 10.9 | 6.4 | 0.013-5.4 | 1.1-31 |
| 80 | 18Nd—76Fe—3B—3C | −1.03 | −0.63 | 6.9 | 10.9 | 9.4 | 5.9 | 0.011-5.9 | 1.3-18 |
| 81 | 18Nd—76Fe—3B—3C | −0.95 | −0.59 | 7.1 | 10.6 | 9.2 | 5.7 | 0.009-5.8 | 1.1-17 |
| 81a | 18Nd—78Fe—3B—1C | −1.11 | −0.74 | 6.9 | 9.6 | 8.1 | 1.3 | 0.007-7.4 | 2.4-57 |
| 81b | 18Nd—78.5Fe—3B—0.5C | −1.14 | −0.76 | 6.8 | 9.2 | 7.6 | 0.3 | 0.008-10.8 | 2.6-108 |
| 81c | 30Nd—66.5Fe—3B—0.5C | −1.23 | −0.89 | 6.0 | 10.0 | 7.3 | 0.1 | 0.013-26.4 | 1.8-54 |

EXAMPLE 81

Sinters were prepared by repeating the procedure of Example 52 except that the alloy powder produced by atomizing the molten crude alloy in the argon atmosphere was subjected to heat treatment at 800° C. for 15 h followed by cooling, and the powder thus obtained was compacted in the non-magnetic field. With respect to the sinters thus obtained, the oxidation resistance, the C content of the protective film, the size of magnetic crystal grains, the thickness of the protective film and the magnetic characteristics were evaluated as in Example 52 and the results are shown in Table 9.

EXAMPLES 81a-81c

Sinters were prepared by repeating the procedure of Example 52 except that the starting materials were weighed and mixed to provide the neodymium contents shown in Table 9.

With respect to the sinters thus obtained, the oxidation resistance, the C content of the protective film, the size of magnetic crystal grains, the thickness of the protective film and the magnetic characteristics were evaluated as in Example 52 and the results are shown in Table 9.

The advantage of the present invention will be shown below by the following representative examples of the process of the present invention for producing a permanent magnet alloy having a protective film which contains Co.

EXAMPLE 82

Starting materials, which consisted of 99.9% pure electrolytic iron, 99.5% pure electrolytic cobalt, a ferroboron alloy with a boron content of 19.32%, 99.5% pure carbon black, and a 98.5% pure neodymium metal containing other rare-earth elements as impurities, were weighted and mixed in such proportions that a composition designated by 18Nd/61Fe/15Co/3B/3C would be obtained. The mixture was melted under vacuum in a high-frequency induction furnace and thereafter cast into a water-cooled copper mold to form an alloy ingot.

The thus obtained alloy ingot was heat treated at 800° C. for 15 h and then was held to stand in a furnace for cooling.

Then, the alloy ingot was crushed into particles with a jaw crusher and was then coarsely ground to a size of −100 mesh with a stamp mill in an argon gas and was further finely ground to an average particle size of 5 μm by means of a vibrating mill. The thus obtained alloy powder was compacted at a pressure of 1 ton/cm$^2$ in a magnetic field of 10 kOe.

The resulting shaped product was held in an argon gas at 1,100° C. for 1 h and subsequently quenched to obtain a sinter.

COMPARATIVE EXAMPLE 11

A sinter was prepared by repeating the procedure of Example 82 except that the heat treatment of the alloy ingot was omitted.

In order to evaluate the oxidation resistance of the sinters obtained in Example 82 and in Comparative Example 11, they were subjected to an evaluation test for determining the oxidation resistance (a weathering test). This test was carried out by leaving the samples to stand in a hot and humid atmosphere (60° C.×90% RH) for 7 months (5,040 h) and then measuring the demagnetization (drop in Br and iHc). The results are shown in Table 10 and FIG. 11.

Figure 11:
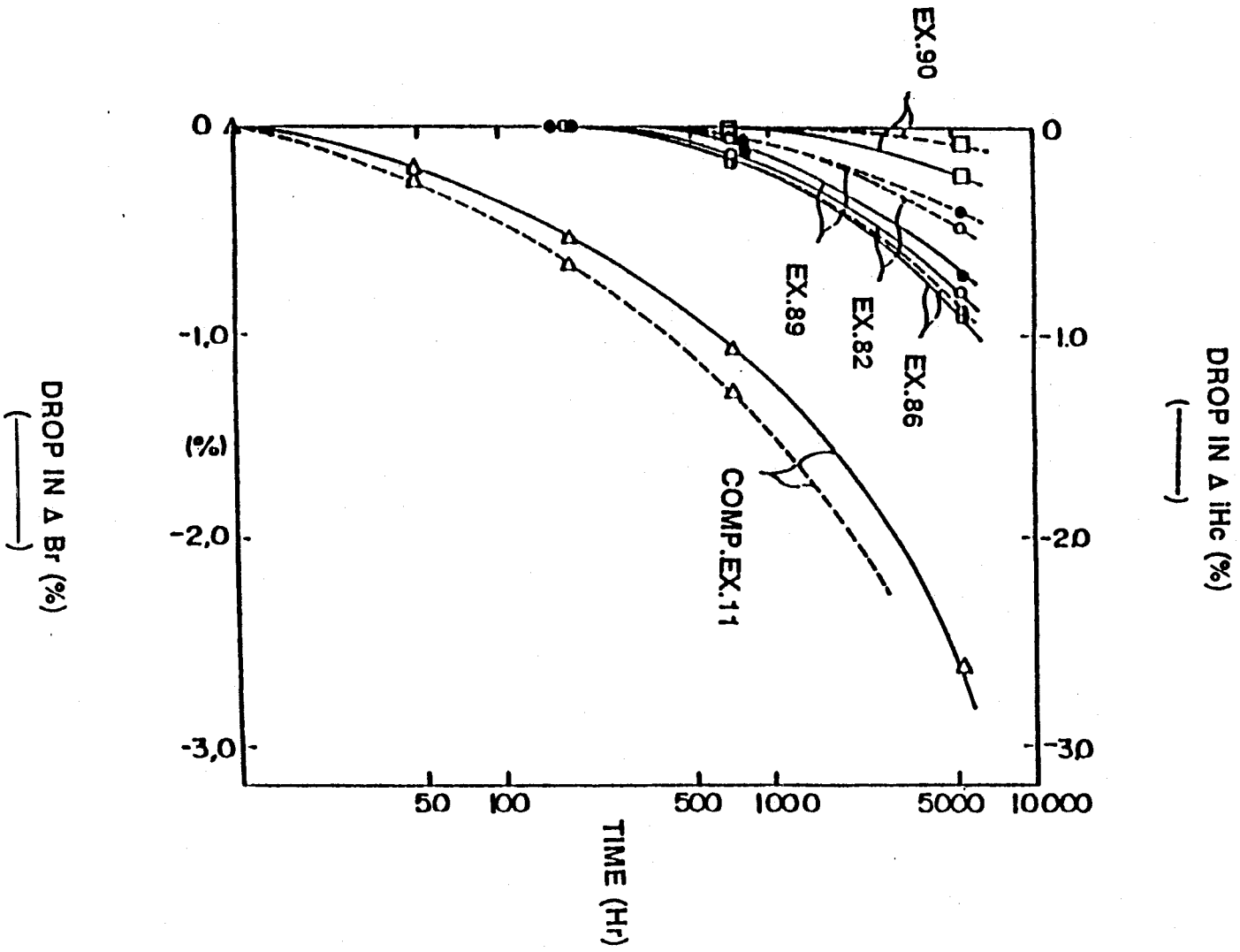
FIG. 11 shows demagnetization curves of Br and iHc for the sintered magnets of the present invention having magnetic crystal grains covered with the C- and Co-containing oxidation-resistant protective film (Examples 82, 86, 89 and 90) and those of the comparative samples having no such protective layer (Comparative Example 11) when they were left to stand at 60° C. and 90% RH with the surface of the magnets being exposed.

As is clear from FIG. 11 and Table 10, the sinter prepared in Example 82 experienced very small degrees of demagnetization as shown by −0.78% in Br, and −0.46% in iHc after 7 months. This shows that the oxidation resistance of this sinter had been remarkably improved. In contrast, the sinter prepared in Comparative Example 11 experienced significant demagnetization as shown by −2.62% in Br and −4.6% in iHc.

Demagnetization data of some other sinters prepared in the examples to be described hereinafter are also shown in FIG. 11.

Figure 12:
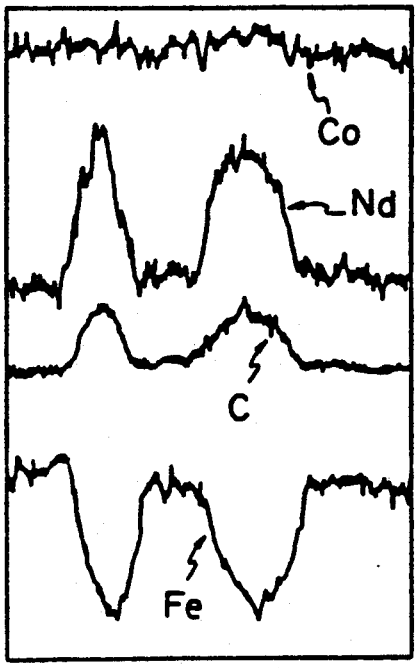
FIG. 12 is a diagram showing the spectral lines of the respective elements as reproduced from a photo showing the result of spectral line analyses for Nd, Fe, Co and C elements in the metallic structure shown in an electron micrograph showing the metallic structure of the magnet of the present invention prepared in Example 82.

FIG. 12 shows spectral lines for the respective elements as reproduced from the photo of spectral line analyses for Fe, C, Co and Nd elements with EPMA. These pictures clearly show that the magnetic crystal grains are covered with a C- and Co-containing oxidation-resistant protective film and that the greater part of C is present in the Nd-rich portion of this protective film. The C content of the protective film was 4.5 wt %, and the Co content of it 21.7 wt %. The size of magnetic crystal grains was measured for 100 grains selected from the SEM micrograph showing the microstructure of the sinter and it was found to be within the range of 1.9–26 μm. The thickness of the protective film as measured with TEM was 0.011–5.7 μm. These values are shown in Table 10 given hereinbelow. Magnetization measurements were conducted with a vibrating sample magnetometer (VSM) and the values of Br, iHc and (BH)max thus measured are shown in Table 10.

As the above results show, the permanent magnet alloy of the present invention is much more resistant to oxidation than the known sample of Comparative Example, and the magnetic characteristics of this alloy are comparable to or better than those of the known sample.

EXAMPLES 83–85

Sinters were prepared by repeating the procedure of Example 82 except that the heat treatment temperature of the alloy ingot and the holding time were, in the respective case, 600° C.×24 h (in Example 83), 1,000° C.×0.5 h (in Example 84) and 1,100° C.×0.5 h (in Example 85).

The oxidation resistance of each sinter, the C and Co contents of the protective film, the size of magnetic crystal grains, the thickness of the protective film and the magnetic characteristics of each sinter were evaluated as in Example 82 and the results are shown in Table 10.

EXAMPLE 86

Starting materials, which consisted of 99.9% pure electrolytic iron, 99.5% pure electrolytic cobalt, a ferroboron alloy with a boron content of 19.32%, 99.5% pure carbon black and a 98.5% pure neodymium metal (containing other rare-earth elements as impurities), were weighed and mixed in such proportions that a composition designated by 18Nd/61Fe/10Co/3B/1C would be obtained. The mixture was melted under vacuum in a high-frequency induction furnace and thereafter cast into a water-cooled copper mold to form an alloy ingot.

The thus obtained alloy ingot was crushed with a jaw crusher and the crushed ingot was then coarsely ground to a size of −100 mesh with a stamp mill in an argon gas. Thereafter, 99.5% pure carbon black and 99.5% pure electrolytic cobalt were added to the coarsely ground ingot in such an amount that a composition designated by 18Nd/61Fe/15Co/3B/3C would be obtained. Then, the mixture was finely ground to an average particle size of 5 μm by means of a vibrating mill.

The thus obtained alloy powder was compacted at a pressure of 1 ton/cm$^2$ in a magnetic field of 10 kOe, and the compacted product was sintered by holding it in an argon gas at 1,100° C. for 1 h and subsequently quenched to obtain a sinter. With respect to the sinter thus obtained, the C and Co contents of the protective film, the size of magnetic crystal grains, the thickness of the protective film and the magnetic characteristics were evaluated as in Example 82 and the results are shown in Table 11.

EXAMPLES 87–88

Sinters were prepared by repeating the procedure of Example 86 except that the amount each of carbon and cobalt for the primary addition to be made in the melting stage and that for the secondary addition to be made either in the coarsely grinding stage or in the finely grinding stage were changed as shown in Table 11.

With respect to the sinters thus obtained, the C and Co contents of the protective film, the size of magnetic crystal grains, the thickness of the protective film and the magnetic characteristics were evaluated as in Example 82 and the results are shown in Table 11. The primary composition as given in Table 11 means the composition in the melting stage, and the secondary composition as given in the same table means that in the sintering stage.

EXAMPLE 89

Sinters were prepared by repeating the procedure of Example 86 except that the extra stage of subjecting the alloy ingot to heat treatment at 700° C. for 18 h was added. With respect to the sinters thus obtained, the oxidation resistance, the C and Co contents of the protective film, the size of magnetic crystal grains, the thickness of the protective film and the magnetic characteristics were evaluated as in Example 82 and the results are shown in Table 11.

EXAMPLES 90-96

Sinters were prepared by repeating the procedure of Example 82 except that the temperature of sintering, the holding time for sintering, the slow cooling rate after sintering and the temperature at which quenching was to start were changed as shown in Table 12. With respect to the sinters thus obtained, the oxidation resistance, the C and Co contents of the protective film, the size of magnetic crystal grains, the thickness of the protective film and the magnetic characteristics were evaluated as in Example 82 and the results are shown in Table 12.

EXAMPLES 97-99

The same procedure as in Example 82 was repeated except that sinters were subjected to the final heat treatment under the conditions as shown in Table 13. With respect to the sinters thus obtained, the oxidation resistance, the C and Co contents of the protective film, the size of magnetic crystal grains, the thickness of the protective film and the magnetic characteristics were evaluated as in Example 82 and the results are shown in Table 13.

EXAMPLES 100-109

Sinters were prepared by repeating the procedure of Example 82 except that the compositions were changed as shown in Table 14. With respect to the sinters thus obtained, the oxidation resistance, the C and Co contents of the protective film, the size of magnetic crystal grains, the thickness of the protective film and the magnetic characteristics were evaluated as in Example 82 and the results are shown in Table 14.

EXAMPLE 110

Sinters were prepared by repeating the procedure of Example 82 except that the compaction of the alloy fine powder was conducted in the non-magnetic field. With respect to the sinters thus obtained, the oxidation resistance, the C and Co contents of the protective film, the size of magnetic crystal grains, the thickness of the protective film and the magnetic characteristics were evaluated as in Example 82 and the results are shown in Table 14.

EXAMPLE 111

Sinters were prepared by repeating the procedure of Example 82 except that the alloy powder produced by atomizing the molten crude alloy in the argon atmosphere was subjected to heat treatment at 800° C. for 15 h followed by cooling, and the powder thus obtained was compacted in the non-magnetic field. With respect to the sinters thus obtained, the oxidation resistance, the C and Co contents of the protective film, the size of magnetic crystal grains, the thickness of the protective film and the magnetic characteristics were evaluated as in Example 82 and the results are shown in Table 14.

EXAMPLES 111a-111c

Sinters were prepared by repeating the procedure of Example 82 except that the starting materials were weighed and mixed in such proportions that a composition would have the neodymium and C contents as shown in Table 14.

With respect to the sinters thus obtained, the oxidation resistance, the C and Co contents of the protective film, the size of magnetic crystal grains, the thickness of the protective film and the magnetic characteristics were evaluated as in Example 82 and the results are shown in Table 14.

TABLE 10

| Example | | 82 | 83 | 84 |
|---|---|---|---|---|
| Composition | | 18Nd—61Fe—15Co—3B—3C | 18Nd—61Fe—15Co—3B—3C | 18Nd—61Fe—15Co—3B—3C |
| Conditions for Heat Treating Alloys | Temperature (°C.) | 800 | 600 | 1,000 |
| | Time (hr) | 15 | 24 | 0.5 |
| Oxidation Resistance (%) | ΔBr | −0.78 | −0.89 | −0.77 |
| | ΔiHc | −0.46 | −0.67 | −0.83 |
| Br | (kG) | 12.2 | 11.7 | 11.5 |
| iHc | (kOe) | 12.9 | 12.1 | 12.8 |
| (BH)max | (MGOe) | 34.0 | 32.2 | 31.9 |
| Content in Protective Film (wt. %) | Co | 21.7 | 21.5 | 21.9 |
| | C | 4.5 | 4.5 | 4.1 |
| Thickness of Protective Film | (μm) | 0.011-5.7 | 0.013-5.8 | 0.011-5.4 |
| Size of Magnetic Crystal Grains | (μm) | 1.9-26 | 2.3-22 | 1.5-27 |

| Example | 85 | Comparative 11 |
|---|---|---|
| Composition | 18Nd—61Fe—15Co—3B—3C | 18Nd—61Fe—15Co—3B—3C |

TABLE 10-continued

| | | | |
|---|---|---|---|
| Conditions for Heat Treating Alloys | Temperature (°C.) | 1,000 | — |
| | Time (hr) | 0.5 | — |
| Oxidation Resistance (%) | ΔBr | −0.78 | −2.62 |
| | ΔiHc | −0.68 | −4.60 |
| Br | (kG) | 10.6 | 9.5 |
| iHc | (kOe) | 11.9 | 11.2 |
| (BH)max | (MGOe) | 31.1 | 25.5 |
| Content in Protective Film (wt. %) | Co | 20.9 | 15.5 |
| | C | 4.6 | 2.3 |
| Thickness of Protective Film | (μm) | 0.013–5.9 | 0.010–5.3 |
| Size of Magnetic Crystal Grains | (μm) | 0.8–18 | 1.4–23 |

TABLE 11

| Example | | 86 | 87 | 88 | 89 |
|---|---|---|---|---|---|
| Composition | 1st | 18Nd—61Fe—10Co—3B—1C | 18Nd—61Fe—10Co—3B—2C | 18Nd—61Fe—10Co—3B | 18Nd—61Fe—10Co—3B—1C |
| | 2nd | 18Nd—61Fe—15Co—3B—3C | 18Nd—61Fe—15Co—3B—3C | 18Nd—61Fe—15Co—3B—3C | 18Nd—61Fe—15Co—3B—3C |
| Conditions for Heat Treating Alloys | Temperature (°C.) | — | — | — | 700 |
| | Time (hr) | — | — | — | 18 |
| Oxidation Resistance (%) | ΔBr | −0.90 | −1.02 | −0.78 | −0.69 |
| | ΔiHc | −0.87 | −1.72 | −0.70 | −0.38 |
| Br | (kG) | 11.1 | 10.8 | 12.0 | 12.1 |
| iHc | (kOe) | 11.9 | 11.7 | 12.5 | 12.7 |
| (BH)max | (MGOe) | 28.1 | 27.7 | 30.0 | 33.1 |
| Content in Protective Film (wt. %) | Co | 22.1 | 21.4 | 21.8 | 21.1 |
| | C | 4.3 | 4.8 | 4.6 | 4.1 |
| Thickness of Protective Film | (μm) | 0.009–5.6 | 0.012–5.3 | 0.009–5.5 | 0.013–6.0 |
| Size of Magnetic Crystal Grains | (μm) | 1.3–27 | 1.1–22 | 1.6–26 | 2.0–23 |

TABLE 12

| Example | | 90 | 91 | 92 | 93 |
|---|---|---|---|---|---|
| Composition | | 18Nd—61Fe—15Co—3B—3C | 18Nd—61Fe—15Co—3B—3C | 18Nd—61Fe—15Co—3B—3C | 18Nd—61Fe—15Co—3B—3C |
| Conditions for Sintering | Temperature (°C.) | 1,000 | 1,150 | 1,100 | 1,100 |
| | Time (hr) | 3.0 | 0.5 | 1.0 | 1.0 |
| Slow Cooling Rate | (°C./min) | Quenching | Quenching | 1 | 10 |
| Starting Temperature of Quenching | (°C.) | 1,000 | 1,150 | 600 | 600 |
| Oxidation Resistance (%) | ΔBr | −0.78 | −0.66 | −0.58 | −0.58 |
| | ΔiHc | −0.66 | −0.54 | −0.41 | −0.45 |
| Br | (kG) | 11.7 | 11.6 | 12.7 | 12.4 |
| iHc | (kOe) | 12.9 | 13.0 | 13.1 | 12.4 |
| (BH)max | (MGOe) | 32.4 | 32.2 | 34.7 | 33.7 |
| Content in Protective Film (wt. %) | Co | 21.6 | 21.2 | 22.1 | 21.9 |
| | C | 4.7 | 4.2 | 5.1 | 4.6 |
| Thickness of Protective Film | (μm) | 0.009–5.2 | 0.010–5.6 | 0.013–5.1 | 0.010–5.6 |
| Size of | (μm) | 2.1–26 | 0.9–22 | 1.6–29 | 2.1–28 |

TABLE 12-continued

| Magnetic Crystal Grains | | | | |
|---|---|---|---|---|
| Example | | 94 | 95 | 96 |
| Composition | | 18Nd—61Fe—15Co—3B—3C | 18Nd—61Fe—15Co—3B—3C | 18Nd—61Fe—15Co—3B—3C |
| Conditions for Sintering | Temperature (°C.) | 1,100 | 1,100 | 1,100 |
| | Time (hr) | 1.0 | 1.0 | 1.0 |
| Slow Cooling Rate | (°C./min) | 20 | 10 | 10 |
| Starting Temperature of Quenching | (°C.) | 600 | 800 | 1,000 |
| Oxidation Resistance (%) | ΔBr | −0.66 | −0.61 | −0.64 |
| | ΔiHc | −0.48 | −0.45 | −0.53 |
| Br | (kG) | 12.2 | 12.0 | 11.8 |
| iHc | (kOe) | 12.5 | 13.0 | 12.4 |
| (BH)max | (MGOe) | 33.1 | 32.8 | 32.6 |
| Content in Protective Film (wt. %) | Co | 21.0 | 22.4 | 20.9 |
| | C | 4.9 | 5.3 | 4.1 |
| Thickness of Protective Film | (μm) | 0.009-5.2 | 0.012-5.4 | 0.012-5.1 |
| Size of Magnetic Crystal Grains | (μm) | 1.5-21 | 1.8-30 | 1.2-24 |

TABLE 13

| Example | | 97 | 98 | 99 |
|---|---|---|---|---|
| Composition | | 18Nd—61Fe—15Co—3B—3C | 18Nd—61Fe—15Co—3B—3C | 18Nd—61Fe—15Co—3B—3C |
| Conditions for Final Heat Treatment | Temperature (°C.) | 600 | 800 | 1,000 |
| | Time (hr) | 20 | 10 | 0.5 |
| Oxidation Resistance (%) | ΔBr | −0.66 | −0.68 | −0.67 |
| | ΔiHc | −0.49 | −0.46 | −0.50 |
| Br | (kG) | 12.0 | 12.1 | 12.2 |
| iHc | (kOe) | 14.4 | 15.0 | 14.1 |
| (BH)max | (MGOe) | 33.8 | 33.5 | 34.1 |
| Content in Protective Film (wt. %) | Co | 22.3 | 21.6 | 22.1 |
| | C | 4.6 | 4.8 | 4.2 |
| Thickness of Protective Film | (μm) | 0.13-5.9 | 0.011-6.1 | 0.009-5.6 |
| Size of Magnetic Crystal Grains | (μm) | 1.7-26 | 1.2-24 | 0.9-29 |

TABLE 14

| Example | | 100 | 101 | 102 |
|---|---|---|---|---|
| Composition | | 18Nd—56Fe—15Co—1B—10C | 18Pr—56Fe—15Co—1B—10C | 8Pr—10Nd—56Fe 15Co—1B—10C |
| Oxidation Resistance (%) | ΔBr | −0.22 | −0.15 | −0.28 |
| | ΔiHc | −0.07 | −0.18 | −0.16 |
| Br | (kG) | 11.2 | 10.7 | 10.7 |
| iHc | (kOe) | 11.9 | 11.1 | 11.7 |
| (BH)max | (MGOe) | 30.6 | 27.6 | 27.5 |
| Content in Protective Film (wt. %) | Co | 20.3 | 22.1 | 21.6 |
| | C | 6.8 | 6.2 | 6.4 |
| Thickness of Protective Film | (μm) | 0.009-5.4 | .013-5.2 | 0.011-5.6 |

TABLE 14-continued

| | | | | |
|---|---|---|---|---|
| Size of Magnetic Crystal Grains | (μm) | 1.5-28 | 1.2-26 | 1.9-22 |
| Example | | 103 | 104 | 105 |
| Composition | | 8La—10-Nd—56Fe—15Co—1B—10C | 8Ce—10-Nd—56Fe—15Co—1B—10C | 8Sm—10-Nd—56Fe—15Co—1B—10C |
| Oxidation Resistance (%) | ΔBr | −0.22 | −0.32 | −0.20 |
| | ΔiHc | −0.25 | −0.18 | −0.09 |
| Br | (kG) | 10.8 | 10.4 | 10.8 |
| iHc | (kOe) | 9.3 | 11.2 | 7.0 |
| (BH)max | (MGOe) | 21.1 | 22.4 | 27.2 |
| Content in Protective Film (wt. %) | Co | 21.4 | 20.6 | 22.1 |
| | C | 6.5 | 6.7 | 6.4 |
| Thickness of Protective Film | (μm) | 0.010-5.1 | 0.008-5.2 | 0.012-5.8 |
| Size of Magnetic Crystal Grains | (μm) | 1.8-26 | 0.9-27 | 1.2-22 |
| Example | | 106 | 107 | 108 |
| Composition | | 8Dy—10-Nd—56Fe—15Co—1B—10C | 8Tb—10-Nd—56Fe 15Co—1B—10C | 8Er—10-Nd—56Fe—15Co—1B—10C |
| Oxidation Resistance (%) | ΔBr | −0.22 | −0.18 | −0.15 |
| | ΔiHc | −0.18 | −0.17 | −0.14 |
| Br | (kG) | 9.9 | 8.7 | 9.9 |
| iHc | (kOe) | 23.0 | 14.8 | 11.9 |
| (BH)max | (MGOe) | 28.8 | 19.8 | 24.5 |
| Content in Protective Film (wt. %) | Co | 22.0 | 19.8 | 21.6 |
| | C | 6.1 | 6.9 | 7.0 |
| Thickness of Protective Film | (μm) | 0.013-6.2 | 0.011-5.1 | 0.010-5.8 |
| Size of Magnetic Crystal Grains | (μm) | 1.4-29 | 1.2-21 | 1.8-26 |
| Example | | 109 | 110 | 111 |
| Composition | | 8Y—10-Nd—56Fe—15Co—1B—10C | 18Nd—61Fe—15Co—3B—3C | 18Nd—61Fe—15Co—3B—3C |
| Oxidation Resistance (%) | ΔBr | −0.24 | −0.82 | −0.79 |
| | ΔiHc | −0.14 | −0.50 | −0.49 |
| Br | (kG) | 7.6 | 7.1 | 7.3 |
| iHc | (kOe) | 10.1 | 12.1 | 11.9 |
| (BH)max | (MGOe) | 11.7 | 9.8 | 9.9 |
| Content in Protective Film (wt. %) | Co | 21.4 | 23.0 | 22.5 |
| | C | 6.1 | 6.3 | 6.0 |
| Thickness of Protective Film | (μm) | 0.009-5.6 | 0.011-5.8 | 0.010-5.7 |
| Size of Magnetic Crystal Grains | (μm) | 1.1-28 | 0.9-31 | 0.8-30 |
| Example | | 111a | 111b | 111c |
| Composition | | 18Nd—63Fe—15Co—3B—1C | 18Nd—63.5Fe—15Co—3B—0.5C | 30Nd—51.5Fe—15Co—3B—0.5C |
| Oxidation Resistance (%) | ΔBr | −0.89 | −0.91 | −0.98 |
| | ΔiHc | −0.59 | −0.61 | −0.71 |
| Br | (kG) | 7.1 | 7.0 | 6.2 |
| iHc | (kOe) | 10.7 | 10.2 | 11.1 |
| (BH)max | (MGOe) | 8.7 | 8.1 | 7.8 |
| Content in Protec- | Co | 21.5 | 20.9 | 18.1 |
| | C | 1.6 | 0.6 | 0.2 |

TABLE 14-continued

| | | | | |
|---|---|---|---|---|
| tive Film (wt. %) | | | | |
| Thickness of Protective Film | (μm) | 0.008-7.1 | 0.009-10.5 | 0.012-26.1 |
| Size of Magnetic Crystal Grains | (μm) | 2.5-61 | 2.7-111 | 1.9-59 |

What is claimed is:

1. In a process for producing a permanent magnet alloy based on a R—Fe—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising the ingot or powder of the alloy before being sent to the compacting step being subjected to a heat treatment which is carried out at a temperature of 500°-1,100° C. for a period of up to 24 hours so as to produce a permanent magnet alloy based on a R—Fe—B—C system whose individual magnetic crystal grains are covered with an oxidation-resistant protective film which has a C content of 0.05-16 wt % and higher than that of said individual crystal grains and wherein the composition of said magnet alloy as the sum of the magnetic crystal grains and the oxidation-resistant protective film comprises 10-30% R, less than 2%, not inclusive of zero percent, of B, 0.1-20% C, all percentages being on an atomic basis, with the balance being Fe and incidental impurities.

2. In a process for producing a permanent magnet alloy based on an R—Fe—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material being added to a raw material mixture in a step which is after said step of preparing a molten crude alloy, but before said step of compacting the powder so as to produce a permanent magnet alloy based on a R—Fe—B—C system whose individual magnetic crystal grains are covered with an oxidation-resistant protective film which has a C content of 0.05-16 wt % and higher than that of said individual crystal grains and wherein the composition of said magnet alloy as the sum of the magnetic crystal grains and the oxidation-resistant protective film comprises 10-30% R, less than 2%, not inclusive of zero percent, of B, 0.1-20% C, all percentages being on an atomic basis, with the balance being Fe and incidental impurities.

3. In a process for producing a permanent magnet alloy based on a R—Fe—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material being added to the raw material mixture in a step which is after said step of preparing a molten crude alloy, but before said step of compacting the powder, and in that the alloy ingot or powder in a step before said compacting step being subjected to a heat treatment which is carried out at a temperature of 500°-1,100° C. for a period of up to 24 hours so as to produce a permanent magnet alloy based on a R—Fe—B—C system whose individual magnetic crystal grains are covered with an oxidation-resistant protective film which has a C content of 0.05 to 16 wt % and higher than that of said individual crystal grains and wherein the composition of said magnet alloy as the sum of the magnetic crystal grains and the oxidation-resistant protective film comprises 10-30% R, less than 2%, not inclusive of zero percent, of B, 0.1-20% C, all percentages being on an atomic basis, with the balance being Fe and incidental impurities.

4. The process for producing a permanent magnet alloy according to claim 1, 2 or 3, which further comprises another step for finally heat treating the magnet at a temperature of 400°-1,100° C. after said sintering step.

5. The process for producing a permanent magnet alloy according to claim 1, 2 or 3 wherein said oxidation-resistant protective film comprises substantially all of the alloying elements of which said magnetic crystal grains are made, 0.1-16 wt % of said protective film being C.

6. The process for producing a permanent magnet alloy according to claim 4 wherein said oxidation-resistant protective film comprises substantially all of the alloying elements of which said magnetic crystal grains are made, 0.1-16 wt % of said protective film being C.

7. The process for producing a permanent magnet alloy according to claim 1, 2, or 3 wherein said magnetic crystal grains have a particle size of 0.3-150 μm and the oxidation-resistant protective film has a thickness of 0.001-30 μm.

8. The process for producing a permanent magnet alloy according to claim 4 wherein said magnetic crystal grains have a particle size of 0.3-150 μm and the oxidation-resistant protective film has a thickness of 0.001-30 μm.

9. The process for producing a permanent magnet alloy according to claim 1, 2, or 3 wherein said magnetic crystal grains have a particle size of 0.5-50 μm and the oxidation-resistant protective film has a thickness of 0.001-15 μm.

10. The process for producing a permanent magnet alloy according to claim 4 wherein said magnetic crystal grains have a particle size of 0.5-50 μm and the oxidation-resistant protective film has a thickness of 0.001-15 μm.

11. The process for producing a permanent magnet alloy according to claim 1, 2 or 3 wherein the composition of said magnet alloy consists essentially of 10-30% R, less than 2%, not inclusive of zero percent, of B, 0.5-20% C, all percentages being on an atomic basis, with the balance being Fe and incidental impurities.

12. The process for producing a permanent magnet alloy according to claim 4 wherein the composition of said magnet alloy consists essentially of 10–30% R, less than 2%, not inclusive of zero percent, of B, 0.5–20% C, all percentages being on an atomic basis, with the balance being Fe and incidental impurities.

13. The process for producing a permanent magnet alloy according to claim 1, 2 or 3 wherein said sintering step is carried out by holding the material at a temperature in the range of 950°–1,150° C. for a period of 0.5–4 hours followed by slow cooling at a rate in the range of 0.5°–20° C./min. and then quenching from a temperature in the range of 600°–1,050° C.

14. The process for producing a permanent magnet alloy according to claim 4 wherein said sintering step is carried out by holding the material at a temperature in the range of 950°–1,150° C. for a period of 0.5–4 hours followed by slow cooling at a rate in the range of 0.5°–20° C./min. and then quenching from a temperature in the range of 600°–1,050° C.

15. In a process for producing a permanent magnet alloy based on a R—Fe—Co—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising the ingot or powder of the alloy before being sent to the compacting step being subjected to a heat treatment which is carried out at a temperature of 500°–1,100° C. for a period of up to 24 hours so as to produce a permanent magnet alloy based on a R—Fe—Co—B—C system whose individual magnetic crystal grains are covered with an oxidation-resistant protective film which has the C content of 0.05–16 wt % and higher than that of said individual crystal grains and wherein the composition of said magnet alloy comprises 10–30% R, less than 2%, not inclusive of 0 atom %, of B, 0.1–20% C, up to 40%, not inclusive of 0 atom %, of Co, all percentages being on an atomic basis, with the balance being Fe and incidental impurities.

16. In a process for producing a permanent magnet alloy based on a R—Fe—Co—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material and/or Co source material being added to a raw material mixture in a step which is after said step of preparing a molten crude alloy, but before said step of compacting the powder so as to produce a permanent magnet alloy based on a R—Fe—Co—B—C system whose individual magnetic crystal grains are covered with an oxidation resistant protective film which has a C content of 0.05 to 16 wt % and higher than that of said individual crystal grains and wherein the composition of said magnet alloy comprises 10–30% R, less than 2%, not inclusive of 0 atom %, of B, 0.1–20% C, up to 40%, not inclusive of 0 atom %, of Co, all percentages being on an atomic basis, with the balance being Fe and incidental impurities.

17. In a process for producing a permanent magnet alloy based on a R—Fe—Co—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material and/or a Co source material being added to a raw material mixture in a step which is after said step of preparing a molten crude alloy, but before said step of compacting the powder, and in that the alloy ingot or powder obtained in the step before said compacting step being subjected to a heat treatment which is carried out at a temperature of 500°–1,100° C. for a period of 0.5 hour or more so as to produce a permanent magnet alloy based on a R—Fe—Co—B—C system whose individual magnetic crystal grains are covered with an oxidation-resistant protective film which has a C content of 0.05 to 16 wt % and higher than that of said individual crystal grains and wherein the composition of said magnet alloy comprises 10–30% R, less than 2%, not inclusive of 0 atom %, of B, 0.1–20% C, up to 40%, not inclusive of 0 atom %, of Co, all percentages being on an atomic basis, with the balance being Fe and incidental impurities.

18. The process for producing a permanent magnet alloy according to claim 15, 16 or 17 which further comprises another step for finally heat treating the magnet at a temperature of 400°–1,100° C. after said sintering step.

19. The process for producing a permanent magnet alloy according to claim 15, 16 or 17 wherein said oxidation-resistant protective film comprises substantially all of the alloying elements of which said magnetic crystal grains are made, with up to 30, exclusive of 0, wt % of said protective film being Co.

20. The process for producing a permanent magnet alloy according to claim 19 wherein said oxidation-resistant protective film comprises substantially all of the alloying elements of which said magnetic crystal grains are made, with up to 30, exclusive of 0, wt % of said protective film being Co.

21. The process for producing a permanent magnet alloy according to claim 15, 16 or 17 wherein said oxidation-resistant protective film comprises substantially all of the alloying elements of which said magnetic crystal grains are made, with 0.1–16 wt % of said protective film being C, and up to 30, exclusive of 0, wt % of said protective film being Co.

22. The process for producing a permanent magnet alloy according to claim 18 wherein said oxidation-resistant protective film comprises substantially all of the alloying elements of which said magnetic crystal grains are made, with 0.1–16 wt % of said protective film being C, and up to 30, exclusive of 0, wt % of said protective film being Co.

23. The process for producing a permanent magnet alloy according to claim 15, 16 or 17 wherein said magnetic crystal grains have a particle size of 0.3–150 μm and the oxidation-resistant protective film has a thickness of 0.001–30 μm.

24. The process for producing a permanent magnet alloy according to claim 18 wherein said magnetic crystal grains have a particle size of 0.3–150 μm and the oxidation-resistant protective film has a thickness of 0.001–30 μm.

25. The process for producing a permanent magnet alloy according to claim 15, 16 or 17 wherein said magnetic crystal grains have a particle size of 0.5–50 μm and the oxidation-resistant protective film has a thickness of 0.001–15 μm.

26. The process for producing a permanent magnet alloy according to claim 18 wherein said magnetic crystal grains have a particle size of 0.5-50 μm and the oxidation-resistant protective film has a thickness of 0.001-15 μm.

27. The process for producing a permanent magnet alloy according to claim 15, 16 or 17 wherein the composition of said magnet alloy consists essentially of 10-30% R, less than 2%, not inclusive of 0 atom %, of B, 0.5-20% C, up to 40%, not inclusive of 0 atom %, of Co, all percentages being on an atomic basis, with the balance being Fe and incidental impurities.

28. The process for producing a permanent magnet alloy according to claim 18 wherein the composition of said magnet alloy comprises 10-30% R, less than 2%, not inclusive of 0 atom %, of B, 0.5-20% C, up to 40%, not inclusive of 0 atom %, of Co, all percentages being on an atomic basis, with the balance being Fe and incidental impurities.

29. A process for producing a permanent magnet alloy according to claim 15, 16 or 17 wherein said sintering step is carried out by holding the material at a temperature in the range of 950°-1,150° C. for a period of 0.5-4 hour followed by slow cooling at a rate in the range of 0.5°-20° C./min. and then quenching from a temperature in the range of 600°-1,050° C.

30. A process for producing a permanent magnet alloy according to claim 18 wherein said sintering step is carried out by holding the material at a temperature in the range of 950°-1,150° C. for a period of 0.5-4 hour followed by slow cooling at a rate in the range of 0.5°-20° C./min. and then quenching from a temperature in the range of 600°-1,050° C.

31. The process for producing a permanent magnet alloy according to claim 1, 2 or 3 wherein the heat treatment is carried out for 0.5 to 24 hours.

32. The process for producing a permanent magnet alloy according to claim 9, wherein the heat treatment is carried out for 0.5 to 24 hours.

33. The process for producing a permanent magnet alloy according to claim 15, 16 or 17 wherein the heat treatment is carried out for 0.5 to 24 hours.

34. The process for producing a permanent magnet alloy according to claim 25 wherein the heat treatment is carried out for 0.5 to 24 hours.

35. In a process for producing a permanent magnet alloy based on a R—Fe—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising the ingot or powder of the alloy before being sent to the compacting step being subjected to a heat treatment which is carried out at a temperature of 500°-1,100° C. for a period of up to 24 hours so as to produce a permanent magnet alloy based on a R—Fe—B—C system whose individual magnetic crystal grains are covered with an oxidation-resistant protective film which has a C content of 0.05-16 wt % and higher than that of said individual crystal grains and wherein the composition of said magnet alloy as the sum of the magnetic crystal grains and the oxidation-resistant protective film comprises 10-30% R, less than 4%, not inclusive of zero percent, of B, 0.1-20% C, all percentages being on an atomic basis, with the balance being Fe and incidental impurities.

36. In a process for producing a permanent magnet alloy based on an R—Fe—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material being added to a raw material mixture in a step which is after said step of preparing a molten crude alloy, but before said step of compacting the powder so as to produce a permanent magnet alloy based on a R—Fe—B—C system whose individual magnetic crystal grains are covered with an oxidation-resistant protective film which has a C content of 0.05-16 wt % and higher than that of said individual crystal grains and wherein the composition of said magnet alloy as the sum of the magnetic crystal grains and the oxidation-resistant protective film comprises 10-30% R, less than 4%, not inclusive of zero percent, of B, 0.1-20% C, all percentages being on an atomic basis, with the balance being Fe and incidental impurities.

37. In a process for producing a permanent magnet alloy based on a R—Fe—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material being added to the raw material mixture in a step which is after said step of preparing a molten crude alloy, but before said step of compacting the powder, and in that the alloy ingot or powder in a step before said compacting step being subjected to a heat treatment which is carried out at a temperature of 500°-1,100° C. for a period of up to 24 hours so as to produce a permanent magnet alloy based on a R—Fe—B—C system whose individual magnetic crystal grains are covered with an oxidation-resistant protective film which has a C content of 0.05 to 16 wt % and higher than that of said individual crystal grains and wherein the composition of said magnet alloy as the sum of the magnetic crystal grains and the oxidation-resistant protective film comprises 10-30% R, less than 4%, not inclusive of zero percent, of B, 0.1-20% C, all percentages being on an atomic basis, with the balance being Fe and incidental impurities.

38. In a process for producing a permanent magnet alloy based on a R—Fe—Co—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising the ingot or powder of the alloy before being sent to the compacting step being subjected to a heat treatment which is carried out at a temperature of 500°-1,100° C. for a period of up to 24 hours so as to produce a permanent magnet alloy based on a R—Fe—Co—B—C system whose individual magnetic crystal grains are covered with an oxidation-resistant protective film which has the C content of 0.05-16 wt % and higher than that of said individual crystal grains and wherein the composition of said magnet alloy comprises 10-30% R, less than 4%, not inclusive of 0 atom %, of B, 0.1-20% C, up to 40%, not inclusive of 0 atom %, of Co, all percentages being on an atomic basis, with the balance being Fe and incidental impurities.

39. In a process for producing a permanent magnet alloy based on a R—Fe—Co—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material and/or Co source material being added to a raw material mixture in a step which is after said step of preparing a molten crude alloy, but before said step of compacting the powder so as to produce a permanent magnet alloy based on a R—Fe—Co—B—C system whose individual magnetic crystal grains are covered with an oxidation resistant protective film which has a C content of 0.05 to 16 wt % and higher than that of said individual crystal grains and wherein the composition of said magnet alloy comprises 10–30% R, less than 4%, not inclusive of 0 atom %, of B, 0.1–20% C, up to 40%, not inclusive of 0 atom %, of Co, all percentages being on an atomic basis, with the balance being Fe and incidental impurities.

40. In a process for producing a permanent magnet alloy based on a R—Fe—Co—B—C system where R is at least one of the rare earth elements including Y, comprising the steps of preparing a molten crude alloy, producing a powder directly therefrom or by casting it into an alloy ingot and then grinding it into the powder, compacting the thus obtained powder and sintering the compacted product, the improvement comprising part or all of a C source material and/or a Co source material being added to a raw material mixture in a step which is after said step of preparing a molten crude alloy, but before said step of compacting the powder, and in that the alloy ingot or powder obtained in the step before said compacting step being subjected to a heat treatment which is carried out at a temperature of 500°–1,100° C. for a period of 0.5 hour or more so as to produce a permanent magnet alloy based on a R—Fe—Co—B—C system whose individual magnetic crystal grains are covered with an oxidation-resistant protective film which has a C content of 0.05 to 16 wt % and higher than that of said individual crystal grains and wherein the composition of said magnet alloy comprises 10–30% R, less than 4%, not inclusive of 0 atom %, of B, 0.1–20% C, up to 40%, not inclusive of 0 atom %, of Co, all percentages being on an atomic basis, with the balance being Fe and incidental impurities.

41. The process of claim 35 wherein B is used in an amount of up to 3%.

42. The process of claim 36 wherein B is used in an amount of up to 3%.

43. The process of claim 37 wherein B is used in an amount of up to 3%.

44. The process of claim 38 wherein B is used in an amount of up to 3%.

45. The process of claim 39 wherein B is used in an amount of up to 3%.

46. The process of claim 40 wherein B is used in an amount of up to 3%.

* * * * *

UNITED STATES PATENT AND TRADEMARK OFFICE

CERTIFICATE OF CORRECTION

PATENT NO. : 5,183,630

DATED : February 2, 1993

INVENTOR(S) : Toshio UEDA et al

It is certified that error appears in the above-identified patent and that said Letters Patent is hereby corrected as shown below:

Column 52, line 35 (claim 20), delete "claim 19" and insert --claim 18--.

Signed and Sealed this

Thirtieth Day of August, 1994

*Attest:*

*Attesting Officer*

BRUCE LEHMAN

*Commissioner of Patents and Trademarks*